US010373540B2

(12) United States Patent
Yang et al.

(10) Patent No.: US 10,373,540 B2
(45) Date of Patent: Aug. 6, 2019

(54) DISPLAY PANEL

(71) Applicant: Novatek Microelectronics Corp., Hsinchu (TW)

(72) Inventors: Kai-Min Yang, Kaohsiung (TW); Hsueh-Yen Yang, Taoyuan County (TW); Feng-Ting Pai, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 19 days.

(21) Appl. No.: 14/623,483

(22) Filed: Feb. 16, 2015

(65) Prior Publication Data

US 2016/0171917 A1 Jun. 16, 2016

(30) Foreign Application Priority Data

Dec. 12, 2014 (TW) ..... 103143494 A

(51) Int. Cl.
*G09G 3/20* (2006.01)
*G09G 3/32* (2016.01)
*G09G 3/36* (2006.01)

(52) U.S. Cl.
CPC ... *G09G 3/2003* (2013.01); *G09G 2300/0452* (2013.01)

(58) Field of Classification Search
CPC . G02F 1/133514; G02F 2201/52; G09G 3/20; G09G 2300/0452; G09G 2320/0233; H01L 27/3213
See application file for complete search history.

(56) References Cited

U.S. PATENT DOCUMENTS

| | | | |
|---|---|---|---|
| 7,505,053 | B2 | 3/2009 | Brown Elliott et al. |
| 7,583,279 | B2 | 9/2009 | Brown Elliott et al. |
| 8,786,645 | B2 | 7/2014 | Gu |
| 9,418,586 | B2 | 8/2016 | Gu |
| 9,558,689 | B2 | 1/2017 | Yang et al. |
| 9,734,745 | B2 | 8/2017 | Gu |
| 2005/0018110 | A1 | 1/2005 | Liu |

(Continued)

FOREIGN PATENT DOCUMENTS

| | | |
|---|---|---|
| CN | 1722193 | 1/2006 |
| CN | 101051648 | 10/2007 |

(Continued)

OTHER PUBLICATIONS

"Office Action of Taiwan Counterpart Application," dated Oct. 2, 2015, p. 1-p. 5, in which the listed foreign references were cited.

(Continued)

*Primary Examiner* — Amare Mengistu
*Assistant Examiner* — Jennifer L Zubajlo
(74) *Attorney, Agent, or Firm* — JCIPRNET

(57) ABSTRACT

A display panel including a plurality of sub-pixel groups is provided. The sub-pixel groups are arranged repeatedly to form a pixel array, and each of the sub-pixel groups is written by a plurality of pixel data. The sub-pixel group includes a plurality of main type pixel units and a plurality of sub type pixel units. Each of the main type pixel units is written by one pixel data among the plurality of pixel data, and each of the sub type pixel units is written by at least one pixel data among the plurality of pixel data. The main type pixel units are arranged to form a geometry form and the main type pixel units surround a single sub type pixel unit among the sub type pixel units.

20 Claims, 17 Drawing Sheets

(56) References Cited

U.S. PATENT DOCUMENTS

2005/0225574 A1* 10/2005 Brown Elliott ... G02F 1/133514 345/694
2005/0225575 A1* 10/2005 Brown Elliott ... G02F 1/133514 345/694
2008/0001525 A1 1/2008 Chao et al.
2008/0049112 A1* 2/2008 Lee ..... H01L 27/14603 348/222.1
2009/0058873 A1* 3/2009 Brown Elliott ..... G06T 5/009 345/589
2011/0063482 A1* 3/2011 Kim ..... H04N 5/3745 348/273
2013/0027437 A1 1/2013 Gu
2014/0300626 A1 10/2014 Gu
2015/0002376 A1 1/2015 Yang et al.
2015/0035874 A1 2/2015 Gu
2015/0253476 A1 9/2015 Shao et al.
2016/0027368 A1* 1/2016 Guo ..... G02F 1/133514 345/694
2016/0204094 A1* 7/2016 Yang ..... H01L 27/124 257/773
2017/0301737 A1 10/2017 Gu

FOREIGN PATENT DOCUMENTS

CN 101510395 8/2009
CN 102903318 1/2013
CN 103529588 1/2014
CN 103544901 1/2014
CN 103544901 A * 1/2014 ..... G02F 1/133514
CN 103544901 A * 1/2014 ..... G02F 1/133514
CN 103903543 7/2014
TW 200945256 11/2009

OTHER PUBLICATIONS

"Office Action of China Counterpart Application," dated Nov. 28, 2017, p. 1-p. 8, in which the listed references were cited.

* cited by examiner

DISPLAY PANEL

CROSS-REFERENCE TO RELATED APPLICATION

This application claims the priority benefit of Taiwan application serial no. 103143494, filed on Dec. 12, 2014. The entirety of the above-mentioned patent application is hereby incorporated by reference herein and made a part of this specification.

BACKGROUND OF THE INVENTION

1. Field of the Invention

The invention relates to a display technology, and particularly relates to a display panel.

2. Description of Related Art

As the display technology advances, the consumers' demands to display apparatuses are becoming higher and higher. Thus, the display panels are now designed toward the objectives of being compact, having a high definition, and having a lower power consumption. Particularly, low power consumption and high brightness are the concerns of people.

However, for the display panels having a high definition, when the resolution (i.e., pixel per inch, PPI) is higher than the highest pixel density (i.e., retina resolution, e.g., 300 ppi) that human eyes can tell, human eyes are unable to determine the brightness vision center of every two pixels in the display panel. In other words, when each pitch between the adjacent red, green, and blue sub-pixels in the display panel is overly small, light of different colors generated by the adjacent red, green, and blue sub-pixels may be blended.

Besides, when the resolution of the display panel is increased, the transmittance is relatively reduced, thus reducing the brightness of the display panel. Therefore, how to develop a display panel having a high transmittance, low power consumption, and high brightness and maintain the color performance of the display panel is certainly an issue for the artisans in this field to work on.

SUMMARY OF THE INVENTION

The invention provides a display panel having a preferable transmittance and brightness.

The invention provides a display panel including a plurality of sub-pixel groups repeated arranged to form a pixel array. Each of the sub-pixel groups is written by a plurality of pixel data, and each of the sub-pixel groups includes a plurality of main type pixel units and a plurality of sub type pixel units. Each of the main type pixel units is written by one of the pixel data, and each of the sub type pixel units is written by at least one of the pixel data. The main type pixel units are arranged in the pixel array to form a geometrical shape and surround one of the sub type pixel units.

According to an embodiment of the invention, the main type pixel units are arranged in the pixel array to form a tetragon.

According to an embodiment of the invention, the main type pixel units and the sub type pixel units are alternately arranged in a first direction of the pixel array, and the main type pixel units and the sub type pixel units are alternately arranged in a second direction of the pixel array.

According to an embodiment of the invention, each of the main type pixel units includes sub-pixels of three different colors, and the sub-pixels of three different colors are selected from three of a red pixel, a blue pixel, a green pixel, and a pixel of another color.

According to an embodiment of the invention, each of the sub type pixel units includes sub-pixels of two different colors, and the sub-pixels of two different colors are selected from two of the red pixel, the blue pixel, the green pixel, and the pixel of another color.

According to an embodiment of the invention, the pixel array includes a plurality of sub-pixels in a second direction, and a ratio between the number of the sub-pixels in the second direction and a resolution of the display panel in the second direction is 5/2.

According to an embodiment of the invention, each of the sub type pixel units is written by one of the pixel data.

According to an embodiment of the invention, the main type pixel units are arranged in the pixel array to form a hexagon.

According to an embodiment of the invention, the main type pixel units and the sub type pixel units are alternately arranged in a first direction of the pixel array.

According to an embodiment of the invention, the main type pixel units and the sub type pixel units are arranged in a second direction of the pixel array, and, in the second direction, each of the sub type pixel units is disposed between each two of the main type pixel units.

According to an embodiment of the invention, each of the main type pixel units includes sub-pixels of two different colors, and the sub-pixels of two different colors are selected from two of a red pixel, a blue pixel, a green pixel, and a pixel of another color.

According to an embodiment of the invention, each of the sub type pixel units includes sub-pixels of three different colors, and the sub-pixels of three different colors are selected from three of the red pixel, the blue pixel, the green pixel, and the pixel of another color.

According to an embodiment of the invention, the pixel array includes a plurality of sub-pixels in a second direction, and a ratio between the number of the sub-pixels in the second direction and a resolution of the display panel in the second direction is 7/3.

According to an embodiment of the invention, the pixel array includes a plurality of sub-pixels in a second direction, and a ratio between the number of the sub-pixels in the second direction and a resolution of the display panel in the second direction is 7/4.

According to an embodiment of the invention, each of the sub type pixel units is written by two of the pixel data.

Based on the above, the display panel of the invention has the sub-pixel group formed with the white sub-pixels to improve the brightness and maintain the color performance of the display panel. In addition, in the display panel of the invention, a suitable algorithm is designed in correspondence with different sub-pixel arrangements and designs, so as to reduce a pixel density when the display panel displays an image. Thus, the display panel of the invention has a preferable transmittance and clearness of pixels.

To make the above features and advantages of the present invention more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
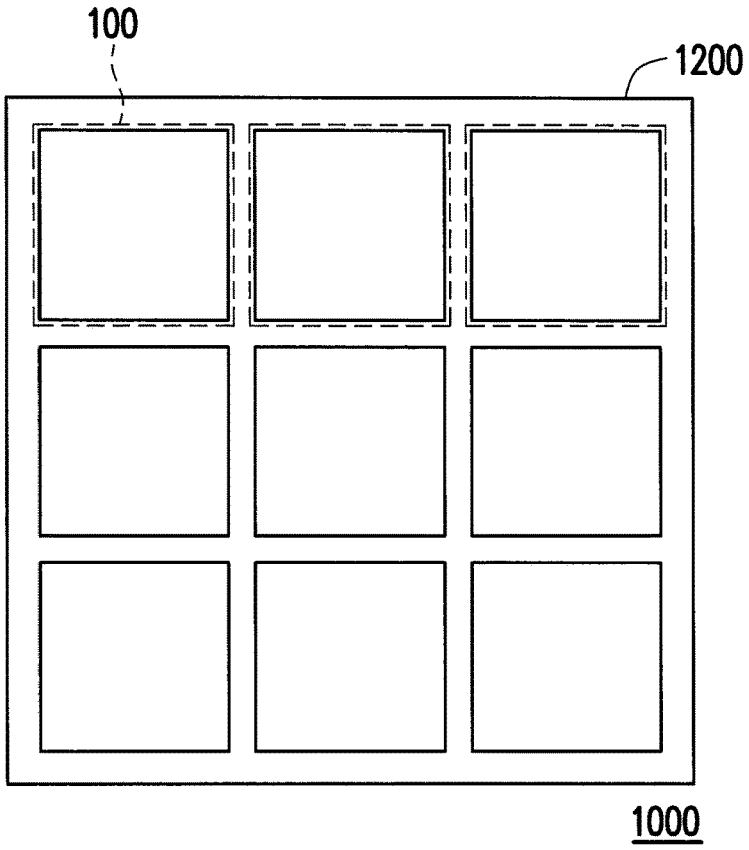
FIG. 1 is a schematic top view illustrating a pixel array according to several exemplary embodiments of the invention.

Reference will now be made in detail to the present preferred embodiments of the invention, examples of which are illustrated in the accompanying drawings. Wherever possible, the same reference numbers are used in the drawings and the description to refer to the same or like parts.

To increase a transmittance, brightness, and clearness of a display panel, a display panel of the invention presents a preferable transmittance, high brightness, and clearness of pixels when displaying an image by arranging sub-pixels of different colors, such as red, blue, green, and white pixels, and designing a suitable algorithm to reduce a pixel density of the display panel. Accordingly, color blending due to light of different colors generated by the sub-pixels in the display panel having a high definition is effectively reduced.

FIG. 1 is a schematic top view illustrating a pixel array according to several exemplary embodiments of the invention.

Referring to FIG. 1, a display panel 1000 includes a plurality of sub-pixel groups 100, and the sub-pixel groups 100 are arranged repeatedly to form a pixel array 1200. In this exemplary embodiment, each of the sub-pixel groups 100 is written by a plurality of pixel data. For example, each of the pixel data is formed by an arrangement of sub-pixels of different colors. Also, by using an algorithm, the pixel data are mapped to each of the sub-pixel groups 100. Specifically, each of the sub-pixel groups 100 includes a plurality of main type pixel units and a plurality of sub type pixel units. Also, each of the main type pixel units is written by one of the pixel data, and each of the sub type pixel units is written by at least one of the pixel data.

Figure 2:
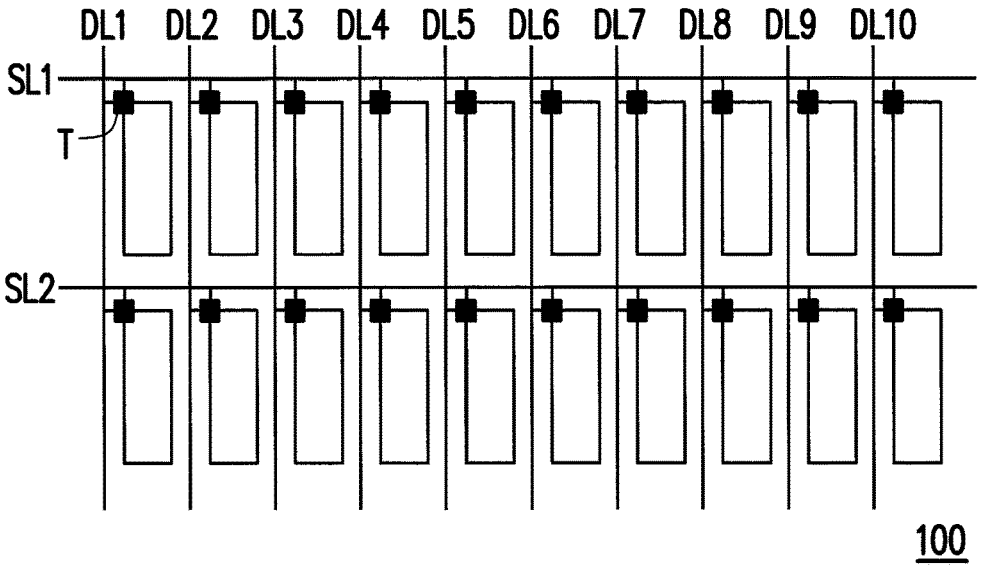
FIG. 2 is a schematic top view illustrating a sub-pixel group according to a first exemplary embodiment of the invention.

FIG. 2 is a schematic top view illustrating a sub-pixel group according to a first exemplary embodiment of the invention.

Referring to FIGS. 1 and 2, for the ease of illustration, FIG. 2 only shows one of the sub-pixel groups 100. However, people having ordinary skills in the art should understand that the pixel array 1200 is an array formed by the plurality of sub-pixel groups 100 (as shown in FIG. 1). The sub-pixel group 100 of this exemplary embodiment includes 20 sub-pixels. Each of the sub-pixels includes a scan line, a data line, and a driving element T. Under a circumstance that the pixel array 1200 is applied in a liquid crystal display (LCD), the driving element T is a thin film transistor (TFT), for example. However, the invention is not limited thereto. If the pixel array 1200 is an organic electro-luminescence (e.g., organic light-emitting diode, OLED) display panel, the driving element T then includes two TFTs and one capacitor, for example. However, the invention is not limited thereto. The driving element T is electrically connected with the scan line and the data line. As shown in FIG. 2, the sub-pixel group 100 of this exemplary embodiment includes two scan lines SL1 and SL2 and ten data lines DL1 to DL10.

FIGS. 3A to 3D are schematic top views illustrating four main type pixel units according to the first exemplary embodiment of the invention, and FIGS. 4A to 4D are schematic top views illustrating four sub type pixel units according to the first exemplary embodiment of the invention.

Figure 3A:
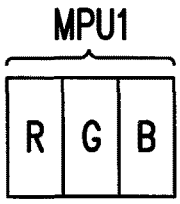
FIGS. 3A to 3D are schematic top views illustrating four main type pixel units according to the first exemplary embodiment of the invention.
Figure 3B:
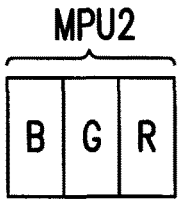
Figure 3C:
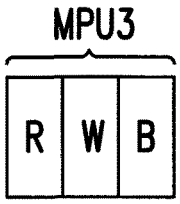
Figure 3D:
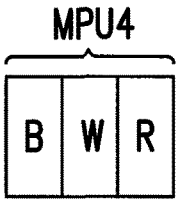

Referring to FIGS. 3A to 3D, in the pixel array 1200 of a display panel 1000, each of the main type pixel units includes sub-pixels of three different colors. Also, the sub-pixels of three different colors are selected from three of a red pixel R, blue pixel B, green pixel G, and a pixel in another color. The pixel in another color may be a white pixel W, but the invention does not limit the color of the pixel of another color. For example, in another exemplary embodiment, the pixel of another color may be a yellow pixel Y or a pixel having a color different from the color of the red pixel R, the blue pixel B, and the green pixel G. For example, in FIG. 3A, the sub-pixels of three different colors included in a main type pixel unit MPU1 are respectively and sequentially the red pixel R, the green pixel G, and the blue pixel B. In FIG. 3B, the sub-pixels of three different colors included in a main type pixel unit MPU2 are respectively and sequentially the blue pixel B, the green pixel G, and the red pixel R. In FIG. 3C, the sub-pixels of three different colors included in a main type pixel unit MPU3 are respectively and sequentially the red pixel R, the white pixel W, and the blue pixel B. In FIG. 3D, the sub-pixels of three different colors included in a main type pixel unit MPU4 are respectively and sequentially the blue pixel B, the white pixel W, and the red pixel R. However, the invention does not limit how the sub-pixels of three different colors in the main type pixel unit are arranged. For example, in another exemplary embodiment, an arrangement of the sub-pixels in the main type pixel unit further includes any arrangement other than the arrangements in the four main type pixel units described above.

Figure 4A:
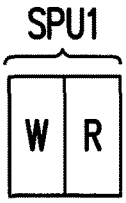
FIGS. 4A to 4D are schematic top views illustrating four sub type pixel units according to the first exemplary embodiment of the invention.
Figure 4B:
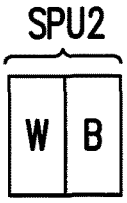
Figure 4C:
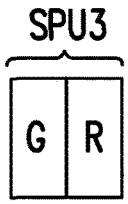
Figure 4D:
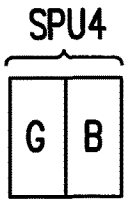

Referring to FIGS. 4A to 4D, in the pixel array 1200 of the display panel 1000, each of the sub type pixel units includes sub-pixels of two different colors. Also, the sub-pixels of two different colors are selected from two of the red pixel, blue pixel, green pixel, and the pixel in another color. The pixel in another color may be the white pixel W, but the invention does not limit the color of the pixel of another color. For example, in another exemplary embodiment, the pixel of another color may be the yellow pixel Y or a pixel having a color different from the color of the red pixel R, the blue pixel B, and the green pixel G. For example, in FIG. 4A, the sub-pixels of two different colors included in a sub type pixel unit SPU1 are sequentially and respectively the white pixel W and the red pixel R. In FIG. 4B, the sub-pixels of two different colors included in a sub type pixel unit SPU2 are sequentially and respectively the white pixel W and the blue pixel B. In FIG. 4C, the sub-pixels of two different colors included in a sub type pixel unit SPU3 are sequentially and respectively the green pixel G and the red pixel R. In FIG. 4D, the sub-pixels of two different colors included in a sub type pixel unit SPU4 are sequentially and respectively the green pixel G and the blue pixel B. However, the invention does not limit how the sub-pixels of two different colors in the sub type pixel unit are arranged. For example, in another exemplary embodiment, an arrangement of the sub-pixels in the sub type pixel unit further includes any arrangement other than the arrangements in the four sub type pixel units described above.

FIGS. 5A to 5D are schematic top views illustrating sub-pixel groups formed by the main type pixel units shown in FIGS. 3A to 3D and the sub type pixel units shown in FIGS. 4A to 4D. For the ease of illustration, components such as the scan lines SL1 and SL2, the data lines DL1 and DL10, and the driving element T are omitted from the illustration of FIGS. 5A to 5D. The sub-pixel group shown in FIGS. 5A to 5D are similar to the sub-pixel group 100 shown in FIG. 2. Therefore, identical or similar components are referred to by identical or similar symbols, and relevant description will not be reiterated below. In the following, the arrangements of the sub-pixels in the respective sub-pixel groups in this exemplary embodiment are respectively described below with reference to the drawings.

Figure 5A:
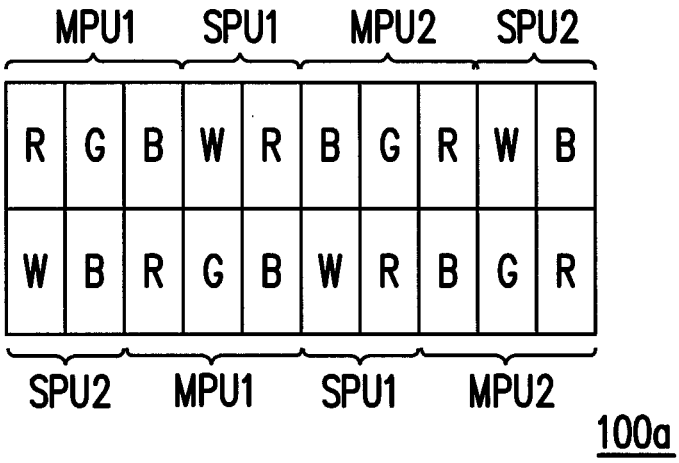
FIGS. 5A to 5D are schematic top views illustrating sub-pixel groups formed by the main type pixel units shown in FIGS. 3A to 3D and the sub type pixel units shown in FIGS. 4A to 4D.

Referring to FIG. 5A, a sub-pixel group 100*a* includes 20 sub-pixels in an array with two rows and ten columns (2×10). In addition, the 20 sub-pixels include six red pixels R, four green pixels G, six blue pixels B, and four white pixels W. In other words, a ratio between the sub-pixels of different colors (i.e., red pixel R:green pixel G:blue pixel B:white pixel W) is 3:2:3:2. Specifically, in this exemplary embodiment, since each of the main type pixel units and each of the sub type pixel units are respectively written by one of the pixel data, the sub-pixel group 100*a* is written by eight pixel data. Moreover, from left to right, the first row of the sub-pixel group 100*a* sequentially includes the main type pixel unit MPU1, the sub type pixel unit SPU1, the main type pixel unit MPU2, and the sub type pixel unit SPU2. From left to right, the second row of the sub-pixel group 100*a* sequentially includes the sub type pixel unit SPU2, the main type pixel unit MPU1, the sub type pixel unit SPU1, and the main type pixel unit MPU2.

Figure 5B:
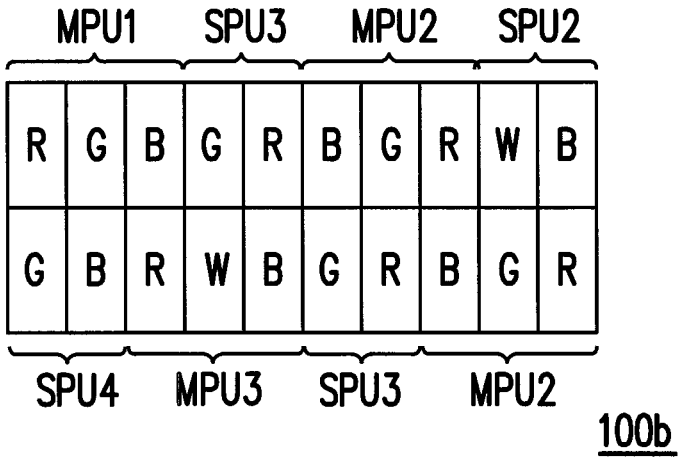

Referring to FIG. 5B, a sub-pixel group 100*b* includes 20 sub-pixels in an array with two rows and ten columns (2×10). In addition, the 20 sub-pixels include six red pixels R, six green pixels G, six blue pixels B, and two white pixels W. In other words, a ratio between the sub-pixels of different colors (i.e., red pixel R:green pixel G:blue pixel B:white pixel W) is 3:3:3:1. Similarly, the sub-pixel group 100*b* is written by eight pixel data, and, from left to right, the first row of the sub-pixel group 100*b* sequentially includes the main type pixel unit MPU1, the sub type pixel unit SPU3, the main type pixel unit MPU2, and the sub type pixel unit SPU2. From left to right, the second row of the sub-pixel group 100*a* sequentially includes the sub type pixel unit SPU4, the main type pixel unit MPU3, the sub type pixel unit SPU3, and the main type pixel unit MPU2.

Figure 5C:
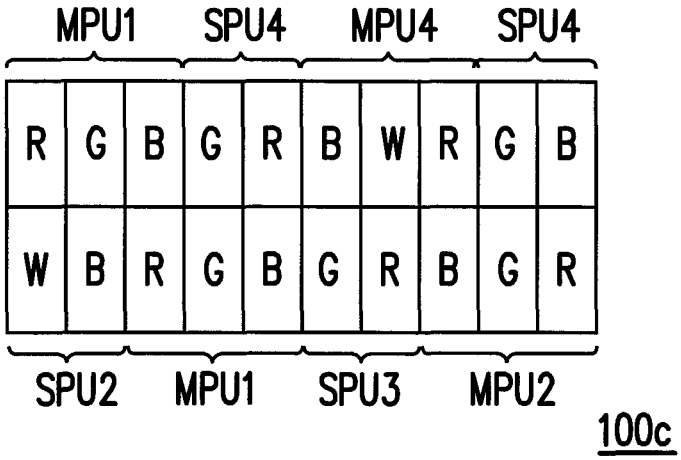

Referring to FIG. 5C, a sub-pixel group 100*c* includes 20 sub-pixels in an array with two rows and ten columns (2×10). In addition, the 20 sub-pixels include six red pixels R, six green pixels G, six blue pixels B, and two white pixels W. In other words, a ratio between the sub-pixels of different colors (i.e., red pixel R:green pixel G:blue pixel B:white pixel W) is 3:3:3:1. Similarly, the sub-pixel group 100*c* is written by eight pixel data, and, from left to right, the first row of the sub-pixel group 100*c* sequentially includes the main type pixel unit MPU1, the sub type pixel unit SPU4, the main type pixel unit MPU2, and the sub type pixel unit SPU2, and, from left to right, the second row of the sub-pixel group 100*c* sequentially includes the sub type pixel unit SPU2, the main type pixel unit MPU1, the sub type pixel unit SPU3, and the main type pixel unit MPU2. It should be noted that in the sub-pixel groups shown in FIGS. 5B and 5C, two of the white pixels W in the sub-pixel group 100*a* shown in FIG. 5A are replaced by the green pixels G. In this way, the ratio of the red pixel R, green pixel G, and blue pixel B in the sub-pixel groups 100*b* and 100*c* becomes 1:1:1. Accordingly, an yield rate of the display panel 1000 maybe improved.

Figure 5D:
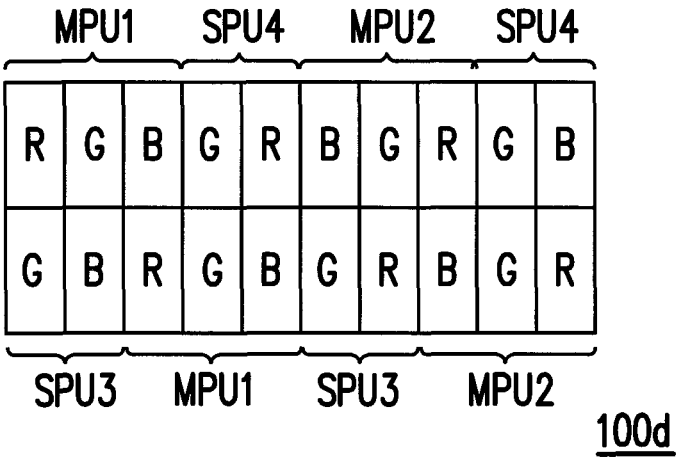

Referring to FIG. 5D, a sub-pixel group 100*d* includes 20 sub-pixels in an array with two rows and ten columns (2×10). In addition, the 20 sub-pixels include six red pixels R, eight green pixels G, and six blue pixels B. In other words, a ratio between the sub-pixels of the colors (i.e., red pixel R:green pixel G:blue pixel B) is 3:4:3. Similarly, the sub-pixel group 100*d* is written by eight pixel data, and, from left to right, the first row of the sub-pixel group 100*d* sequentially includes the main type pixel unit MPU1, the sub type pixel unit SPU4, the main type pixel unit MPU2, and the sub type pixel unit SPU4, and, from left to right, the second row of the sub-pixel group 100*c* sequentially includes the sub type pixel unit SPU3, the main type pixel unit MPU1, the sub type pixel unit SPU3, and the main type pixel unit MPU2. In particular, the sub-pixel group 100*d* shown in FIG. 5D is obtained by replacing all of the white pixels W in the sub-pixel group 100*a*, the sub-pixel group 100*b*, and the sub-pixel group 100*c* respectively shown in FIGS. 5A, 5B, and 5C with the green pixels G.

Figure 6:
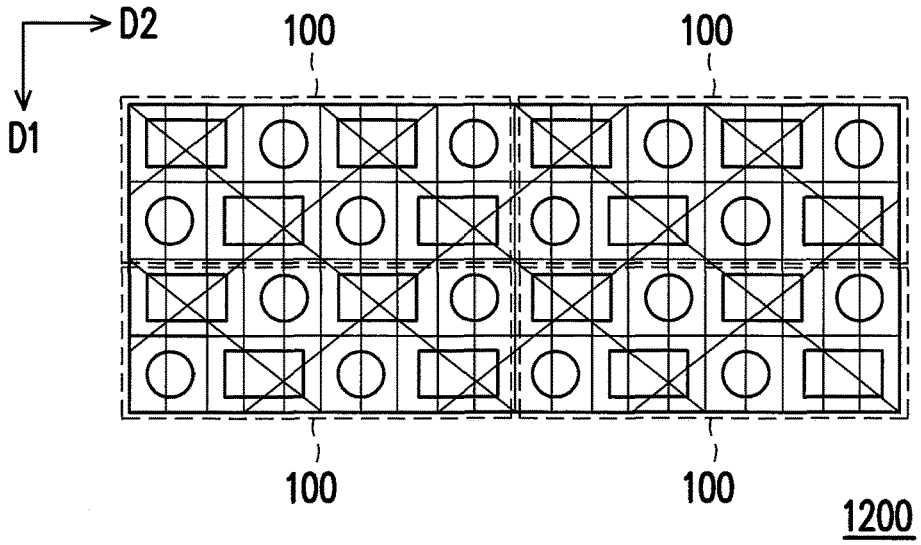
FIG. 6 is a schematic top view illustrating a pixel array 1200 having a plurality of sub-pixel groups 100 shown in FIG. 2 according to the first exemplary embodiment of the invention.

FIG. 6 is a schematic top view illustrating a pixel array 1200 having a plurality of sub-pixel groups 100 shown in FIG. 2 according to the first exemplary embodiment of the invention.

For the ease of illustration, FIG. 6 only illustrates four of the sub-pixel groups 100, and components such as the scan lines, data lines, and driving elements of the sub-pixels are omitted. As shown in FIG. 6, the pixel array 1200 is an array formed by the repeatedly arranged sub-pixel groups 100. It should be noted that the invention does not limit the sub-pixel groups forming the pixel array 1200. For example, the pixel array 1200 is formed by the sub-pixel groups 100*a* to 100*d* shown in FIGS. 5A to 5D, and each of the sub-pixel groups 100*a* and 100*d* is written by eight pixel data. However, the invention is not limited thereto. In another exemplary embodiment, the pixel array 1200 may be formed by other sub-pixel groups. Here, rectangles are used to represent the main type pixel units of the pixel array 1200, and circles are used to represent the sub type pixel units of the pixel array 1200.

Referring to FIG. 6, the main type pixel units represented by the rectangles are arranged to form a geometrical shape in the pixel array 1200, and surround one of the sub type pixel units. In this exemplary embodiment, each of the sub type pixel units is written by one of the pixel data. In other words, the one of the pixel data is formed of an arrangement of the sub-pixels of two different colors. Also, with an algorithm, the one of the pixel data may be mapped to the sub type pixel unit. In particular, in FIG. 6 showing the rectangles representing the main type pixel units and the circles representing the sub type pixel units that form the pixel array 1200, the main and sub type pixel units are alternately arranged in a direction D1 (first direction D1 hereinafter) parallel to the data line of the pixel array 1200, and the main and sub type pixel units are also alternately arranged in a direction D2 (second direction D2 hereinafter) parallel to the scan line of the pixel array 1200. Thus, the main type pixel units form a tetragon in the pixel array, and surround one of the sub type pixel units.

Figure 7:
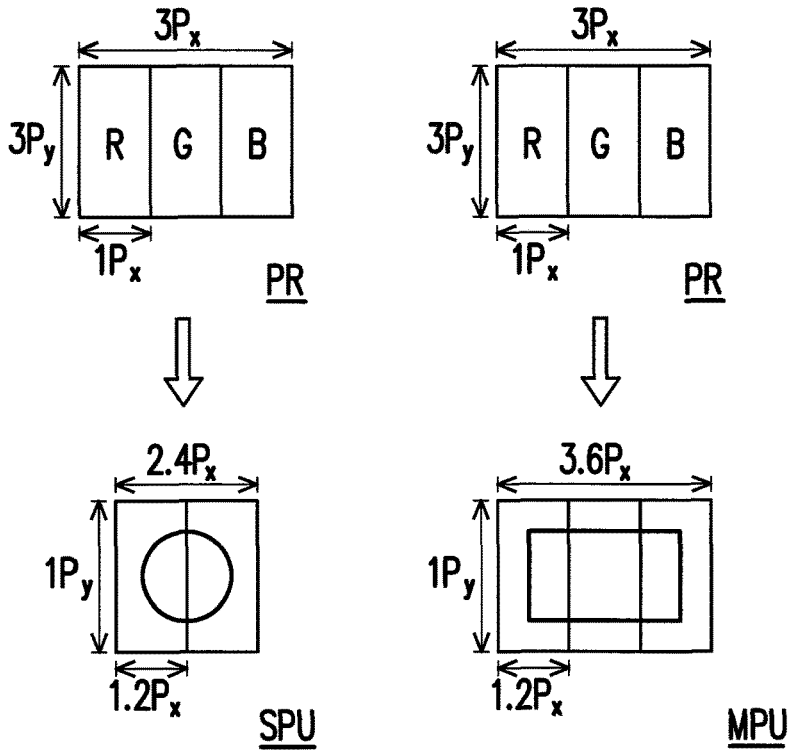
FIG. 7 is a diagram illustrating a corresponding relation between normal pixel data and pixel data defined by an algorithm according to the first exemplary embodiment of the invention.

FIG. 7 is a diagram illustrating a corresponding relation between normal pixel data and pixel data defined by an algorithm according to the first exemplary embodiment of the invention.

Referring to FIG. 7, in a conventional RGB strip type display panel, a pixel data corresponding to a pixel PR includes three sub-pixels, namely the red pixel R, green pixel G, and blue pixel B. In the exemplary embodiment of the invention, the pixel data are formed of arrangements of different numbers of sub-pixels of different colors, and the algorithm is used to map the pixel data to the main type pixel units MPU and the sub type pixel units SPU. The arrangements of the different numbers of the sub-pixels of different colors in the main type pixel units MPU and the sub type pixel units SPU are already described in FIGS. 3A to 3D and FIGS. 4 A to 4D, and thus not repeated below. For example, in this exemplary embodiment, each of the main type pixel units MPU includes sub-pixels of three different colors, and each of the sub type pixel units SPU includes sub-pixels of two different colors. More specifically, in the conventional display panel, two pixel data corresponding to two pixels PR include six sub-pixels. However, in the display panel of this exemplary embodiment, the pixel data corresponding to two pixel units correspond to five sub-pixels (i.e., two sub-pixels of the sub type pixel unit SPU and three sub-pixels of the main type pixel unit MPU). In other words, in this exemplary embodiment, assuming that the size of the display panel remains the same, each pixel data has 5/2 sub-pixels in average. Thus, a size of the sub-pixel in the sub type pixel unit SPU and the main type pixel unit MPU is 1.2 times of a size of the sub-pixel in the pixel PR. In other words, assuming that a width of the sub-pixel of the conventional RGB strip type display panel is 1P, a width of the sub-pixel of the display panel of this exemplary embodiment is 1.2P. In particular, since the size of the sub-pixel in the display panel of the invention is greater than that in the conventional RGB strip type display panel, a transmittance of the display panel 1000 is increased.

For example, assuming that a frame resolution of the display panel 1000 is 1920×1080, and in the exemplary embodiment of the invention, the pixel array 1200 includes the plurality of sub-pixels in the second direction D2, since each of the pixel data has 5/2 sub-pixels, the number of sub-pixels in the second direction D2 is equal to 5/2 times a resolution in the second direction D2 (i.e., 1080 ppi). In other words, the number of sub-pixels in the second direction D2 is 2700. In other words, a ratio between the number of sub-pixels in the second direction D2 and the resolution of the display panel 1000 in the second direction D2 is 5/2. Since the number of sub-pixels of the conventional RGB strip type display panel in the second direction D2 is 3240, a pixel density the display panel 1000 according to the exemplary embodiment of the invention is relatively reduced, making each pitch between the adjacent red, green, and blue sub-pixels in the display panel 1000 not overly small. Thus, a design of color arrangement of the sub-pixels of the invention is capable of improving the yield rate in manufacturing the display panel and reducing power consumption under the premise that an image clearness is maintained.

It should be noted that as shown in FIG. 7, since the one of the pixel data corresponding to the sub type pixel unit SPU corresponds to two sub-pixels, and the one of the pixel data corresponding to the main type pixel unit MPU corresponds to three sub-pixels, a resolution capability of the main type pixel unit is higher than that of the sub type pixel unit. In particular, with the arrangement shown in FIG. 6, the main type pixel units having a higher resolution surround one of the sub type pixel units. Therefore, the clearness of the display panel is maintained.

Figure 8:
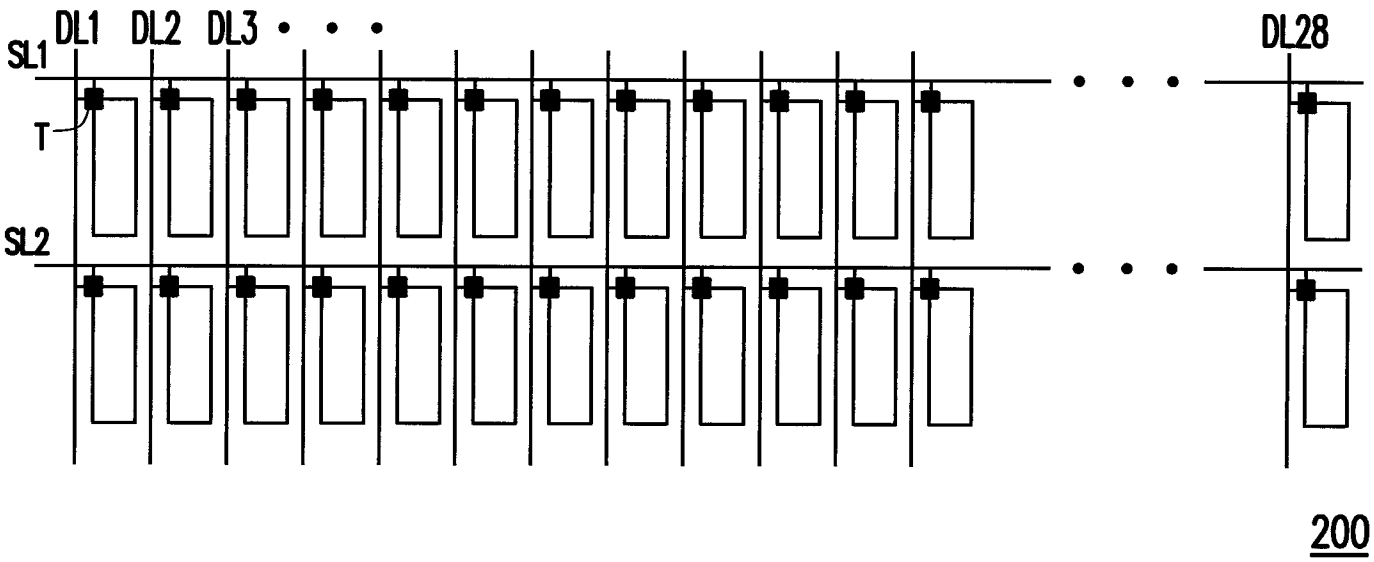
FIG. 8 is a schematic top view illustrating a sub-pixel group according to a second exemplary embodiment of the invention.

FIG. 8 is a schematic top view illustrating a sub-pixel group according to a second exemplary embodiment of the invention.

For the ease of illustration, FIG. 8 only shows one sub-pixel group 200. However, people having ordinary skills in the art should understand that a plurality of the sub-pixel groups 200 form the pixel array 1200 shown in FIG. 1. The sub-pixel group 200 of this exemplary embodiment includes 56 sub-pixels. Each of the sub-pixels includes a scan line, a data line, and the driving element T. The driving element T is electrically connected with the scan line and the data line. As shown in FIG. 8, each of the sub-pixel groups 200 of this exemplary embodiment includes the two scan lines SL1 and SL2 and 28 data lines DL1 to DL28. Here, the same as the first exemplary embodiment, each of the sub-pixel groups 200 is written by a plurality of pixel data. For example, each of the sub-pixel groups 200 includes a plurality of main type pixel units and a plurality of sub type pixel units. Also, each of the main type pixel units is written by one of the pixel data, and each of the sub type pixel units is written by one of the pixel data.

Here, in the pixel array 1200 of the display panel 1000, each of the main type pixel units includes sub-pixels of two different colors, and the sub-pixels of two different colors are selected from two of the red pixel R, blue pixel B, green pixel G, and a pixel of another color. Each of the sub type pixel units includes sub-pixels of three different colors. Also, the sub-pixels of three different colors are selected from three of the red pixel, blue pixel, green pixel, and the pixel of another color. As previously described, the pixel of another color is the white pixel W, for example. However, the invention does not limit the color of the pixel of another color. For example, in another exemplary embodiment, the pixel of another color may be the yellow pixel Y or a pixel having a color different from the color of the red pixel R, the blue pixel B, and the green pixel G. In particular, the invention does not limit arrangements of the sub-pixels of two different colors in each of the main type pixel units and the sub-pixels of three different colors in each of the sub type pixel units. In other words, the arrangement of the sub-pixels of two different colors in the main type pixel unit may be any arrangement and combination of sub-pixels of two of the red pixel R, blue pixel B, green pixel G, and white pixel W. In addition, the arrangement of the sub-pixels of three different colors in the sub type pixel unit may be any arrangement and combination of sub-pixels of three of the red pixel R, blue pixel B, green pixel G, and white pixel W. Besides, the invention does not limit that the colors of the three sub-pixels in the sub type pixel unit are different. For example, in another exemplary embodiment, two of the three sub-pixels may have the same color, and the two sub-pixels of the same color are not adjacent.

FIGS. 9A to 9E are schematic top views illustrating sub-pixel groups formed by main type pixel units and sub type pixel units according to a second exemplary embodiment of the invention. For the ease of illustration, components such as the scan lines SL1 and SL2, the data lines DL1 to DL28, and the driving element T are omitted from the illustration of FIGS. 9A to 9E. The sub-pixel group shown in FIGS. 9A to 9E are similar to the sub-pixel group 200 shown in FIG. 8. Therefore, identical or similar components are referred to by identical or similar symbols, and relevant description will not be reiterated below. In the following, the arrangements of the sub-pixels in the respective sub-pixel groups in this exemplary embodiment are respectively described below with reference to the drawings.

Figure 9A:
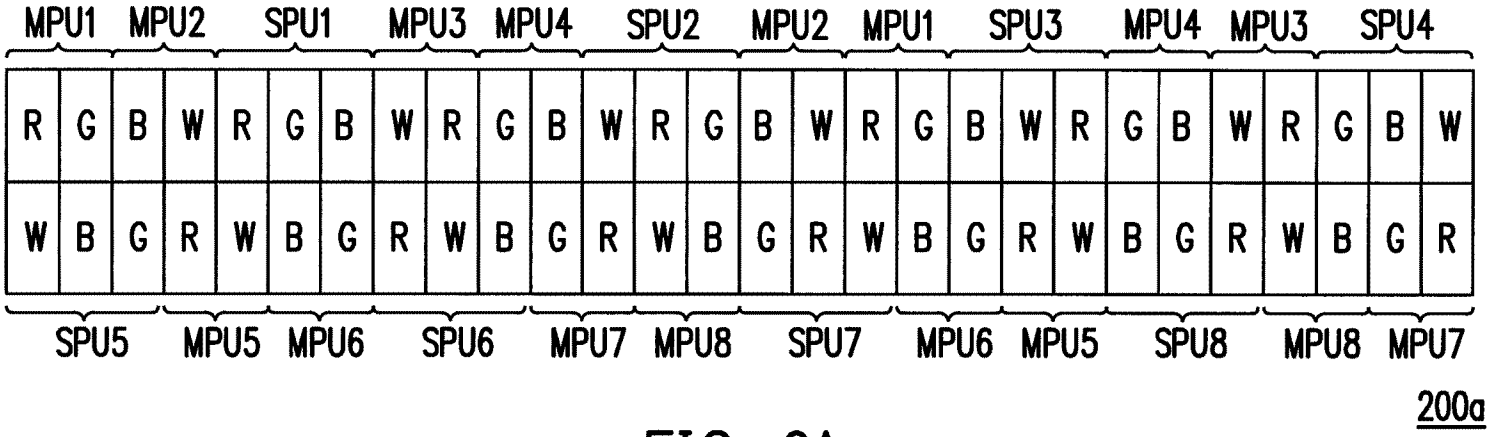
FIGS. 9A to 9E are schematic top views illustrating sub-pixel groups formed by main type pixel units and sub type pixel units according to a second exemplary embodiment of the invention.

Referring to FIG. 9A, a sub-pixel group 200*a* includes 56 sub-pixels in an array with two rows and 28 columns (2×28). In addition, the 56 sub-pixels include 14 red pixels R, 14 green pixels G, 14 blue pixels B, and 14 white pixels W. In other words, a ratio between the sub-pixels of different colors (i.e., red pixel R:green pixel G:blue pixel B:white pixel W) is 1:1:1:1. Specifically, from left to right, the first row of the sub-pixel group 200*a* is formed by a plurality of sets of the red pixel R, the green pixel G, the blue pixel B, and the white pixel W in sequence. From left to right, the second row of the sub-pixel 200*a* is formed by a plurality of sets of the white pixel W, the blue pixel B, the green pixel G, and the red pixel R in sequence. In this exemplary embodiment, since each of the main and sub type pixel units are written by one of the pixel data, the sub-pixel data 200*a* is written by 24 pixel data. For example, from left to right, the first row of the sub-pixel group 200*a* sequentially includes the main type pixel unit MPU1, the main type pixel unit MPU2, the sub type pixel unit SPU1, the main type pixel unit MPU3, the main type pixel unit MPU4, the sub type pixel unit SPU2, the main type pixel unit MPU2, the main type pixel unit MPU1, the sub type pixel unit SPU3, the main type pixel unit MPU4, the main type pixel unit MPU3, and the sub type pixel unit SPU4. From left to right, the second row of the sub-pixel group 200*a* sequentially includes the sub type pixel unit SPU5, the main type pixel unit MPU5, the main type pixel unit MPU6, the sub type pixel unit SPU6, the main type pixel unit MPU7, the main type pixel unit MPU8, the sub type pixel unit SPU7, the main type pixel unit MPU6, the main type pixel unit MPU5, the sub type pixel unit SPU8, the main type pixel unit MPU8, and the main type pixel unit MPU7.

Figure 9B:
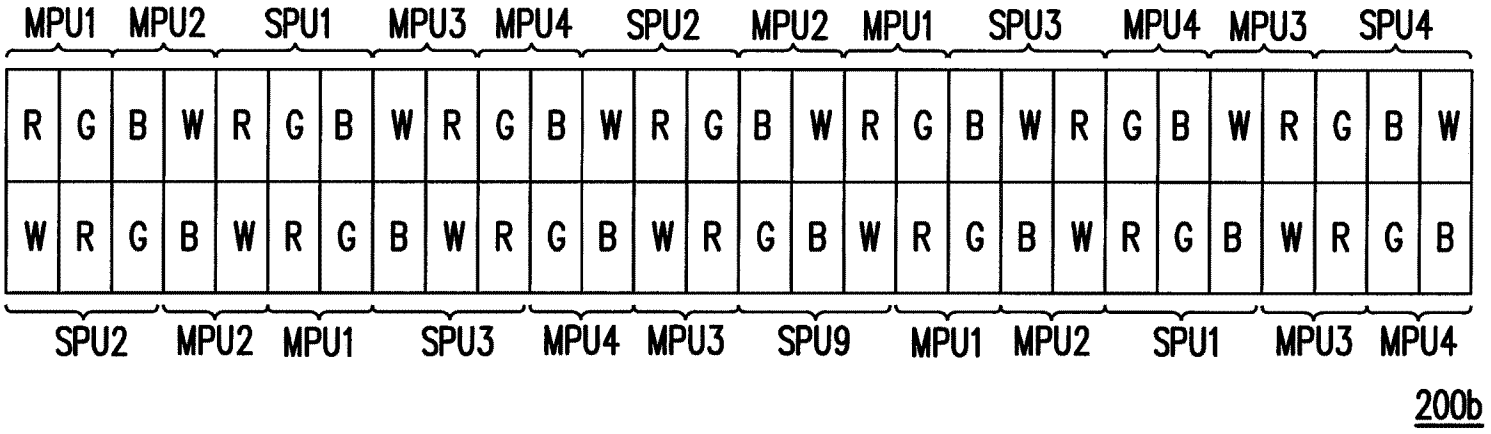

Referring to FIG. 9B, a sub-pixel group 200*b* includes 56 sub-pixels in an array with two rows and 28 columns (2×28). In addition, the 56 sub-pixels include 14 red pixels R, 14 green pixels G, 14 blue pixels B, and 14 white pixels W. In other words, a ratio between the sub-pixels of different colors (i.e., red pixel R:green pixel G:blue pixel B:white pixel W) is 1:1:1:1. Specifically, from left to right, the first row of the sub-pixel group 200*b* is formed by a plurality of sets of the red pixel R, the green pixel G, the blue pixel B, and the white pixel W in sequence, and the second row of the sub-pixel group 200*b* is formed by a plurality of sets of the white pixel W, the red pixel R, the green pixel G, and the blue pixel B in sequence. Similarly, the sub-pixel group 200*b* is written by 24 pixel data, and, from left to right, the first row of the sub-pixel group 200*b* sequentially includes the main type pixel unit MPU1, the main type pixel unit MPU2, the sub type pixel unit SPU1, the main type pixel unit MPU3, the main type pixel unit MPU4, the sub type pixel unit SPU2, the main type pixel unit MPU2, the main type pixel unit MPU1, the sub type pixel unit SPU3, the main type pixel unit MPU4, the main type pixel unit MPU3, and the sub type pixel unit SPU4. From left to right, the second row of the sub-pixel group 200*b* sequentially includes the sub type pixel unit SPU2, the main type pixel unit MPU2, the main type pixel unit MPU1, the sub type pixel unit SPU3, the main type pixel unit MPU4, the main type pixel unit MPU3, the sub type pixel unit SPU9, the main type pixel unit MPU1, the main type pixel unit MPU2, the sub type pixel unit SPU1, the main type pixel unit MPU3, and the main type pixel unit MPU4.

Figure 9C:
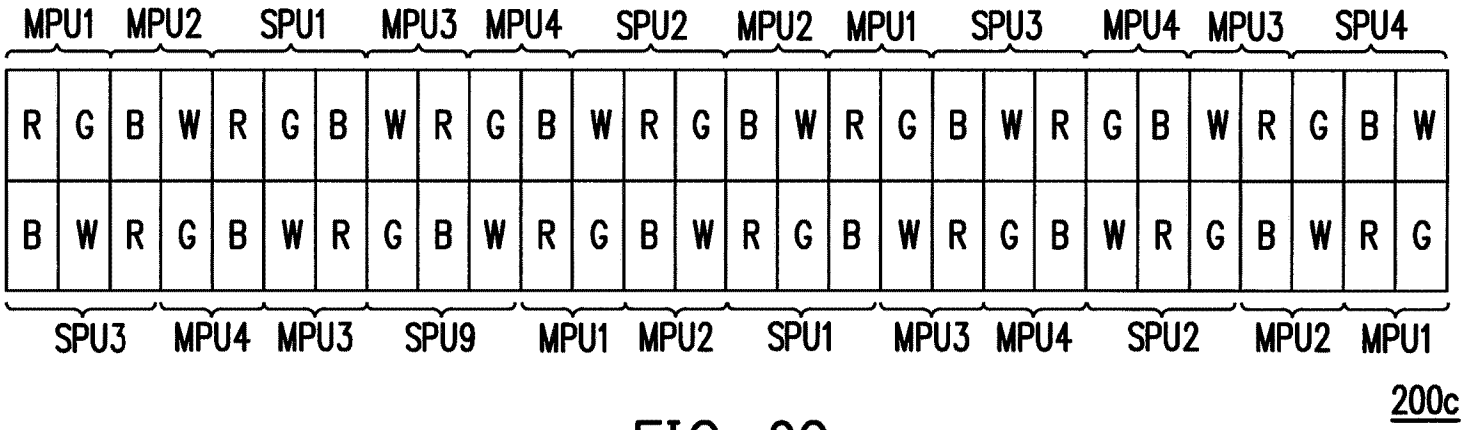

Referring to FIG. 9C, a sub-pixel group 200*c* includes 56 sub-pixels in an array with two rows and 28 columns (2×28). In addition, the 56 sub-pixels include 14 red pixels R, 14 green pixels G, 14 blue pixels B, and 14 white pixels W. In other words, a ratio between the sub-pixels of different colors (i.e., red pixel R:green pixel G:blue pixel B:white pixel W) is 1:1:1:1. Specifically, from left to right, the first row of the sub-pixel group 200*c* is formed by a plurality of sets of the red pixel R, the green pixel G, the blue pixel B, and the white pixel W in sequence, and the second row of the sub-pixel group 200*c* is formed by a plurality of sets of the blue pixel B, the white pixel W, the red pixel R, and the green pixel G in sequence. Similarly, the sub-pixel group 200*c* is written by 24 pixel data, and, from left to right, the first row of the sub-pixel group 200*c* sequentially includes the main type pixel unit MPU1, the main type pixel unit MPU2, the sub type pixel unit SPU1, the main type pixel unit MPU3, the main type pixel unit MPU4, the sub type pixel unit SPU2, the main type pixel unit MPU2, the main type pixel unit MPU1, the sub type pixel unit SPU3, the main type pixel unit MPU4, the main type pixel unit MPU3, and the sub type pixel unit SPU4. From left to right, the second row of the sub-pixel group 200*c* sequentially includes the sub type pixel unit SPU3, the main type pixel unit MPU4, the main type pixel unit MPU3, the sub type pixel unit SPU9, the main type pixel unit MPU1, the main type pixel unit MPU2, the sub type pixel unit SPU1, the main type pixel unit MPU3, the main type pixel unit MPU4, the sub type pixel unit SPU2, the main type pixel unit MPU2, and the main type pixel unit MPU1.

Figure 9D:
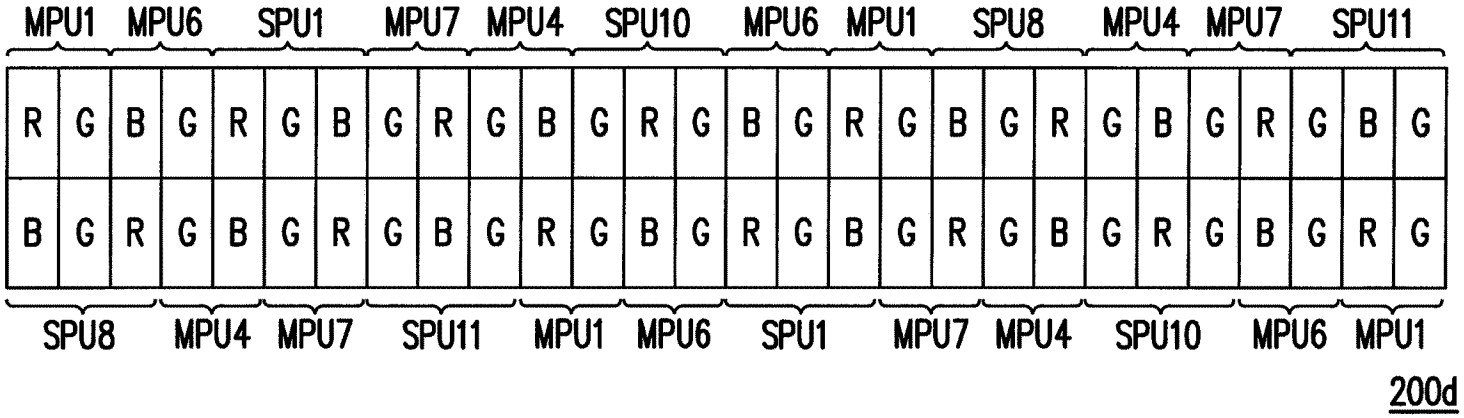

Referring to FIG. 9D, a sub-pixel group 200*d* includes 56 sub-pixels in an array with two rows and 28 columns (2×28). In addition, the 56 sub-pixels include 14 red pixels R, 28 green pixels G, and 14 blue pixels B. In other words, a ratio between the sub-pixels of different colors (i.e., red pixel R:green pixel G:blue pixel B) is 1:2:1. Specifically, from left to right, the first row of the sub-pixel group 200*d* is formed by a plurality of sets of the red pixel R, the green pixel G, the blue pixel B and the green pixel G in sequence, and the second row of the sub-pixel group 200*d* is formed by a plurality of sets of the blue pixel B, the green pixel G, the red pixel R, and the green pixel G in sequence. Similarly, the sub-pixel group 200*d* is written by 24 pixel data, and, from left to right, the first row of the sub-pixel group 200*d* sequentially includes the main type pixel unit MPU1, the main type pixel unit MPU6, the sub type pixel unit SPU1, the main type pixel unit MPU7, the main type pixel unit MPU4, the sub type pixel unit SPU10, the main type pixel unit MPU6, the main type pixel unit MPU1, the sub type pixel unit SPU8, the main type pixel unit MPU4, the main type pixel unit MPU7, and the sub type pixel unit SPU11. From left to right, the second row of the sub-pixel group 200*d* sequentially includes the sub type pixel unit SPU8, the main type pixel unit MPU4, the main type pixel unit MPU7, the sub type pixel unit SPU11, the main type pixel unit MPU1, the main type pixel unit MPU6, the sub type pixel unit SPU1, the main type pixel unit MPU7, the main type pixel unit MPU4, the sub type pixel unit SPU10, the main type pixel unit MPU6, and the main type pixel unit MPU1. In particular, the pixel group 200*d* shown in FIG. 9D is obtained by replacing all of the white pixels D in the sub-pixels of the sub-pixel group 200*c* shown in FIG. 9C with the green pixels G.

Figure 9E:
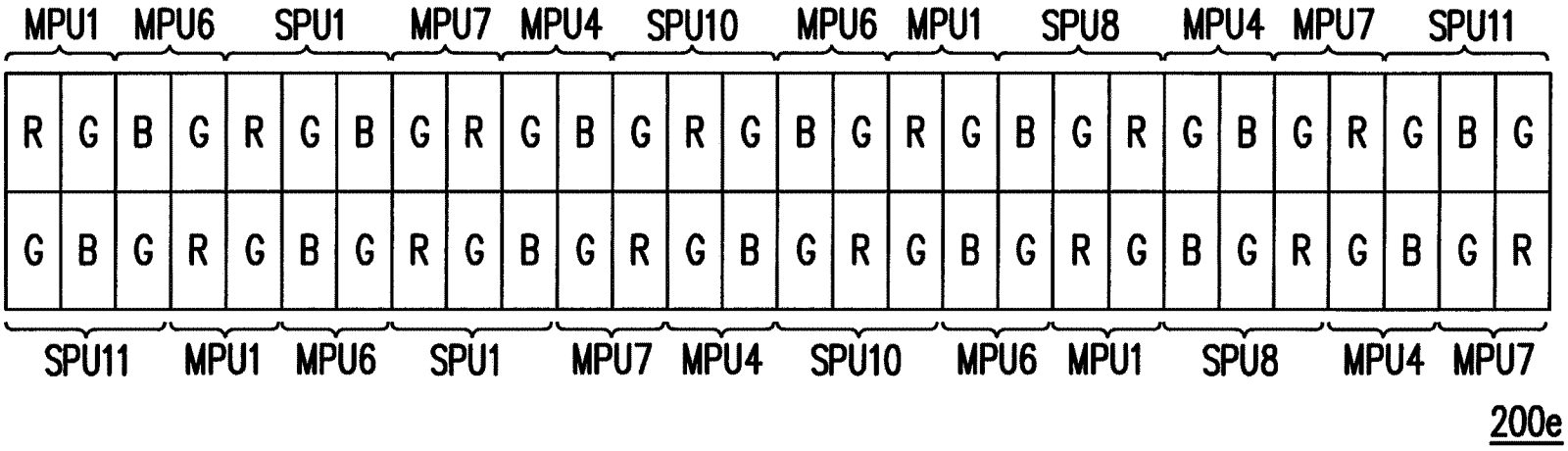

Referring to FIG. 9E, a sub-pixel group 200*e* includes 56 sub-pixels in an array with two rows and 28 columns (2×28). In addition, the 56 sub-pixels include 14 red pixels R, 28 green pixels G, and 14 blue pixels B. In other words, a ratio between the sub-pixels of different colors (i.e., red pixel R:green pixel G:blue pixel B) is 1:2:1. Specifically, from left to right, the first row of the sub-pixel group 200*e* is formed by a plurality of sets of the red pixel R, the green pixel G, the blue pixel B and the green pixel G in sequence, and the second row of the sub-pixel group 200*e* is formed by a plurality of sets of the green pixel G, the blue pixel B, the green pixel G, and the red pixel R in sequence. Similarly, the sub-pixel group 200*e* is written by 24 pixel data, and, from left to right, the first row of the sub-pixel group 200*e* sequentially includes the main type pixel unit MPU1, the main type pixel unit MPU6, the sub type pixel unit SPU1, the main type pixel unit MPU7, the main type pixel unit MPU4, the sub type pixel unit SPU10, the main type pixel unit MPU6, the main type pixel unit MPU1, the sub type pixel unit SPU8, the main type pixel unit MPU4, the main type pixel unit MPU7, and the sub type pixel unit SPU11. From left to right, the second row of the sub-pixel group 200*d* sequentially includes the sub type pixel unit SPU11, the main type pixel unit MPU1, the main type pixel unit MPU6, the sub type pixel unit SPU1, the main type pixel unit MPU7, the main type pixel unit MPU4, the sub type pixel unit SPU10, the main type pixel unit MPU6, the main type pixel unit MPU1, the sub type pixel unit SPU8, the main type pixel unit MPU4, and the main type pixel unit MPU7.

Figure 10:
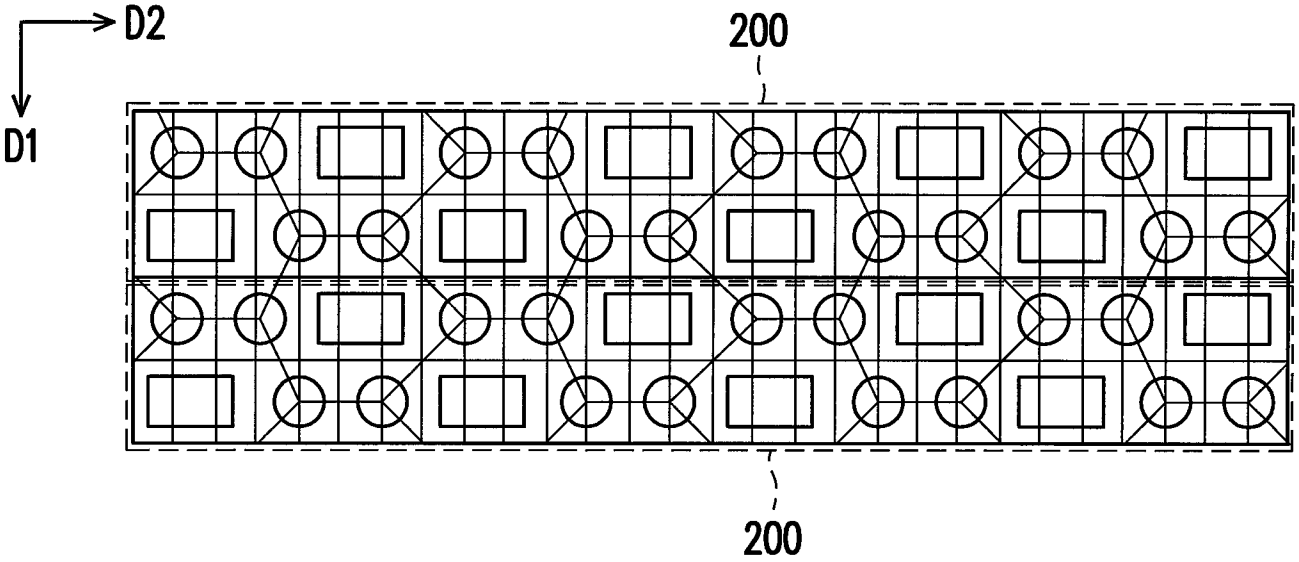
FIG. 10 is a schematic top view illustrating the pixel array 1200 having a plurality of sub-pixel groups 200 shown in FIG. 8 according to the second exemplary embodiment of the invention.

FIG. 10 is a schematic top view illustrating a pixel array 1200 having a plurality of sub-pixel groups 200 shown in FIG. 8 according to the first exemplary embodiment of the invention.

For the ease of illustration, FIG. 10 only illustrates two of the sub-pixel groups 200, and components such as the scan lines, data lines, and driving elements of the sub-pixels are omitted. As shown in FIG. 10, the pixel array 1200 is an array formed by the repeatedly arranged sub-pixel groups 200. It should be noted that the invention does not limit the sub-pixel groups forming the pixel array 1200. For example, the pixel array 1200 is formed by the sub-pixel groups 200*a* to 200*e* shown in FIGS. 9A to 9E, and each of the sub-pixel groups 200*a* and 200*e* is written by 24 pixel data. However, the invention is not limited thereto. In another exemplary embodiment, the pixel array 1200 may be formed by other sub-pixel groups. Here, circles are used to represent the main type pixel units of the pixel array 1200, and rectangles are used to represent the sub type pixel units of the pixel array 1200.

Referring to FIG. 10, in the pixel array 1200 formed by the circles representing the main type pixel units and the rectangles representing the sub type pixel units, the main type pixel units and the sub type pixel units are alternately arranged in the first direction D1 parallel to the scan line of the pixel array 1200. Also, the main type pixel units and the sub type pixel units are alternately arranged in the second direction D2 parallel to the data line of the pixel array 1200. In the second direction D2, each of the sub type pixel units is disposed between each two of the main type pixel units. Accordingly, the main type pixel units in the pixel array 1200 are arranged to form a hexagon. Particularly, in this embodiment, each of the sub type pixel units is written by one of the pixel data. Thus, the main type pixel units surround one of the sub type pixel units written by one of the pixel data.

Figure 11:
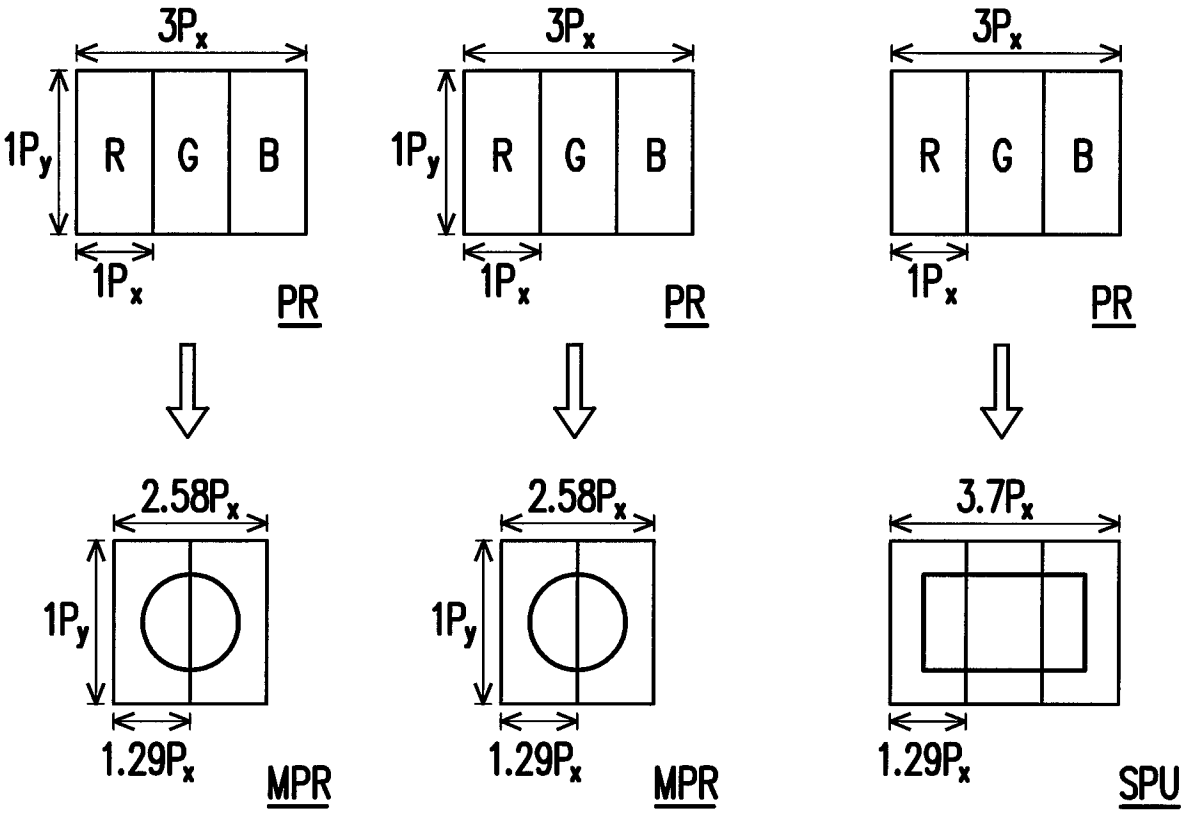
FIG. 11 is a diagram illustrating a corresponding relation between the normal pixel data and pixel data defined by an algorithm according to the second exemplary embodiment of the invention.

FIG. 11 is a diagram illustrating a corresponding relation between the normal pixel data and pixel data defined by an algorithm according to the second exemplary embodiment of the invention.

Referring to FIG. 11, in a conventional RGB strip type display panel, a pixel data corresponding to a pixel PR includes three sub-pixels, namely the red pixel R, green pixel G, and blue pixel B. In the exemplary embodiment of the invention, each pixel data is formed of an arrangement of different numbers of sub-pixels of different colors, and an algorithm is used to map the pixel data to the main type pixel units MPU and the sub type pixel units SPU. The arrangements of the different numbers of sub-pixels of different colors in the main type pixel units MPU and the sub type pixel units SPU are already described in the foregoing, and thus not repeated below. For example, in this exemplary embodiment, each of the main type pixel units MPU includes sub-pixels of two different colors, and each of the sub type pixel units SPU includes sub-pixels of three different colors. More specifically, in the conventional display panel, three pixel data corresponding to three pixels PR include nine sub-pixels. However, in the display panel of this exemplary embodiment, the pixel data corresponding to three pixel units correspond to seven sub-pixels (i.e., four sub-pixels of two main type pixel units MPU and three sub-pixels of one sub type pixel unit SPU). Namely, in this exemplary embodiment, assuming that the size of the display panel remains the same, each pixel data has 7/3 sub-pixels in average. Therefore, the size of the sub-pixel in the main type pixel unit MPU and the sub type pixel unit SPU is 1.29 times of the size of the sub-pixel in the pixel PR. In other words, assuming that the width of the sub-pixel of the conventional RGB strip type display panel is 1P, a width of the sub-pixel of the display panel of this exemplary embodiment is 1.29P. In particular, since the size of the sub-pixel in the display panel of the invention is greater than that in the conventional RGB strip type display panel, the transmittance of the display panel 1000 is increased.

For example, assuming that the frame resolution of the display panel 1000 is 1920×1080, and in the exemplary embodiment of the invention, the pixel array 1200 includes the plurality of sub-pixels in the second direction D2, since each of the pixel data has 7/3 sub-pixels, the number of sub-pixels in the second direction D2 is equal to 7/3 times the resolution in the second direction D2 (i.e., 1080 ppi). In other words, the number of sub-pixels in the second direction D2 is 2520. In other words, a ratio between the number of sub-pixels in the second direction D2 and the resolution of the display panel 1000 in the second direction D2 is 7/3. Since the number of sub-pixels of the conventional RGB strip type display panel in the second direction D2 is 3240, the pixel density of the display panel 1000 according to the exemplary embodiment of the invention is relatively reduced, making each pitch between the adjacent red, green, and blue sub-pixels in the display panel 1000 not overly small. Thus, the yield rate in the manufacture of the display panel is improved.

It should be noted that as shown in FIG. 11, one of the pixel data corresponding to the sub type pixel unit SPU corresponds to three sub-pixels, and one of the pixel data corresponding to the main type pixel unit MPU corresponds to two sub-pixels. In other words, a resolution capability of the sub type pixel unit is higher than that of the main type pixel unit. Particularly, with the arrangement shown in FIG. 10, the main type pixel units surround one of the sub type pixel units. In other words, the sub type pixel units are evenly and regularly distributed in the display panel. Thus, the clearness of the display panel is maintained.

FIGS. 12A to 12E are schematic top views illustrating sub-pixel groups formed by main type pixel units and sub type pixel units according to a third exemplary embodiment of the invention. In this exemplary embodiment, a sub-pixel group of the display panel is the same as the sub-pixel group 200 shown in FIG. 8. In other words, the sub-pixel groups 200 of this exemplary embodiment also form the pixel array 1200 shown in FIG. 1. In addition, the sub-pixel group 200 includes 56 sub-pixels, and each of the sub-pixel groups 200 includes the two scan lines SL1 and SL2 and the 28 data lines DL1 to DL28.

In this exemplary embodiment, like the second exemplary embodiment, each of the sub-pixel groups 200 includes a plurality of main type pixel units and a plurality of sub pixel units. In the pixel array 1200 of the display panel 1000, each of the main type pixel units includes sub-pixels of two different colors, and the sub-pixels of two different colors are selected from two of the red pixel R, blue pixel B, green pixel G, and a pixel of another color. Each of the sub type pixel units includes sub-pixels of three different colors. Also, the sub-pixels of three different colors are selected from three of the red pixel, blue pixel, green pixel, and the pixel of another color. As previously described, the pixel of another color is the white pixel W, for example. However, the invention does not limit the color of the pixel of another color. For example, in another exemplary embodiment, the pixel of another color may be the yellow pixel Y or a pixel having a color different from the color of the red pixel R, the blue pixel B, and the green pixel G. In addition, the invention does not limit arrangements of the sub-pixels of two different colors in each of the main type pixel units and the sub-pixels of three different colors in each of the sub type pixel units. In other words, the arrangement of the sub-pixels of two different colors in the main type pixel unit may be any arrangement and combination of sub-pixels of two of the red pixel R, blue pixel B, green pixel G, and white pixel W. In addition, the arrangement of the sub-pixels of three different colors in each of the sub type pixel units may be any arrangement and combination of sub-pixels of three of the red pixel R, blue pixel B, green pixel G, and white pixel W. Besides, the invention does not limit that the colors of the three sub-pixels in the sub type pixel unit are different. For example, in another exemplary embodiment, two of the three sub-pixels may have the same color, and the two sub-pixels of the same color are not adjacent.

It should be noted that the sub-pixel arrangements of the sub-pixel groups 200*a* to 200*e* shown in FIGS. 12A to 12E are the same as the sub-pixel arrangements of the sub-pixel groups 200*a* to 200*e* shown in FIGS. 9A to 9E. In addition, proportions of the numbers of sub-pixels in the respective colors in the sub-pixel groups 200*a* to 200*e* shown in FIGS. 12A to 12E are the same as proportions of the numbers of sub-pixels in the respective colors in the sub-pixel groups 200*a* to 200*e* shown in FIGS. 9A to 9E. Thus, details in these respects are not repeated below. This exemplary embodiment differs from the first and second exemplary embodiments in that in this exemplary embodiment, each of the main type pixel units of each of the sub-pixel groups 200 is written by one of the pixel data, while each of the sub type pixel units is written by two of the pixel data. In other words, since each of the sub type pixel units is written by two of the pixel data, the two of the pixel data corresponding to the sub type pixel unit is formed of an arrangement of sub-pixels of three different colors. Also, the two of the pixel data are mapped to the corresponding sub type pixel unit through an algorithm. In particular, since each of the sub type pixel units is written by two of the pixel data, the sub-pixel groups 200*a* to 200*e* are written by 32 pixel data.

Figure 12A:
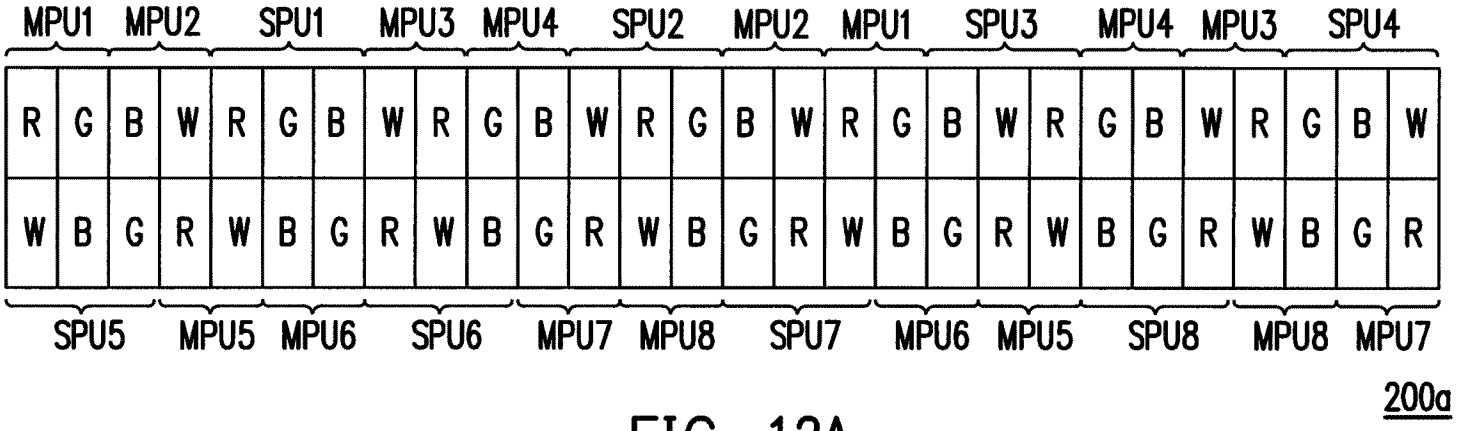
FIGS. 12A to 12E are schematic top views illustrating sub-pixel groups formed by main type pixel units and sub type pixel units according to a third exemplary embodiment of the invention.

Referring to FIG. 12A, since the sub-pixel group 200*a* is written by 32 pixel data, and the sub-pixel arrangement of the sub-pixel group 200*a* is the same as the sub-pixel arrangement of the sub-pixel group 200*a* shown in FIG. 9A, details in this respect will not be repeated below. From left to right, the first row of the sub-pixel group 200*a* sequentially includes the main type pixel unit MPU1, the main type pixel unit MPU2, the sub type pixel unit SPU1, the main type pixel unit MPU3, the main type pixel unit MPU4, the sub type pixel unit SPU2, the main type pixel unit MPU2, the main type pixel unit MPU1, the sub type pixel unit SPU3, the main type pixel unit MPU4, the main type pixel unit MPU3, and the sub type pixel unit SPU4. From left to right, the second row of the sub-pixel group 200*a* sequentially includes the sub type pixel unit SPU5, the main type pixel unit MPU5, the main type pixel unit MPU6, the sub type pixel unit SPU6, the main type pixel unit MPU7, the main type pixel unit MPU8, the sub type pixel unit SPU7, the main type pixel unit MPU6, the main type pixel unit MPU5, the sub type pixel unit SPU8, the main type pixel unit MPU8, and the main type pixel unit MPU7.

Figure 12B:
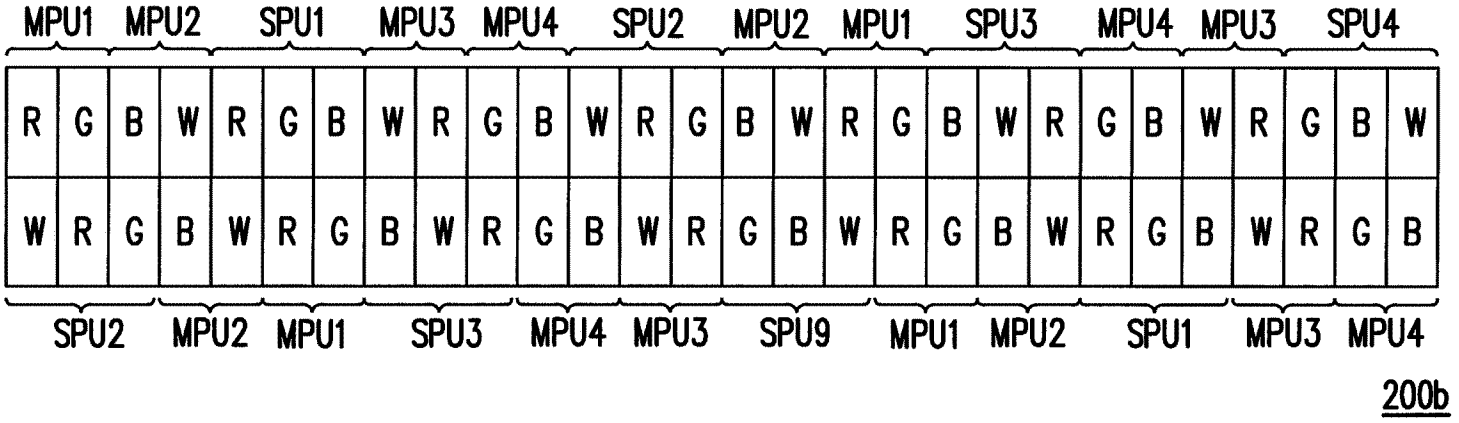

Referring to FIG. 12B, since the sub-pixel group 200*b* is written by 32 pixel data, and the sub-pixel arrangement of the sub-pixel group 200*b* is the same as the sub-pixel arrangement of the sub-pixel group 200*b* shown in FIG. 9B, details in this respect will not be repeated below. From left to right, the first row of the sub-pixel group 200*b* sequentially includes the main type pixel unit MPU1, the main type pixel unit MPU2, the sub type pixel unit SPU1, the main type pixel unit MPU3, the main type pixel unit MPU4, the sub type pixel unit SPU2, the main type pixel unit MPU2, the main type pixel unit MPU1, the sub type pixel unit SPU3, the main type pixel unit MPU4, the main type pixel unit MPU3, and the sub type pixel unit SPU4. From left to right, the second row of the sub-pixel group 200*b* sequentially includes the sub type pixel unit SPU2, the main type pixel unit MPU2, the main type pixel unit MPU1, the sub type pixel unit SPU3, the main type pixel unit MPU4, the main type pixel unit MPU3, the sub type pixel unit SPU9, the main type pixel unit MPU1, the main type pixel unit MPU2, the sub type pixel unit SPU1, the main type pixel unit MPU3, and the main type pixel unit MPU4.

Figure 12C:
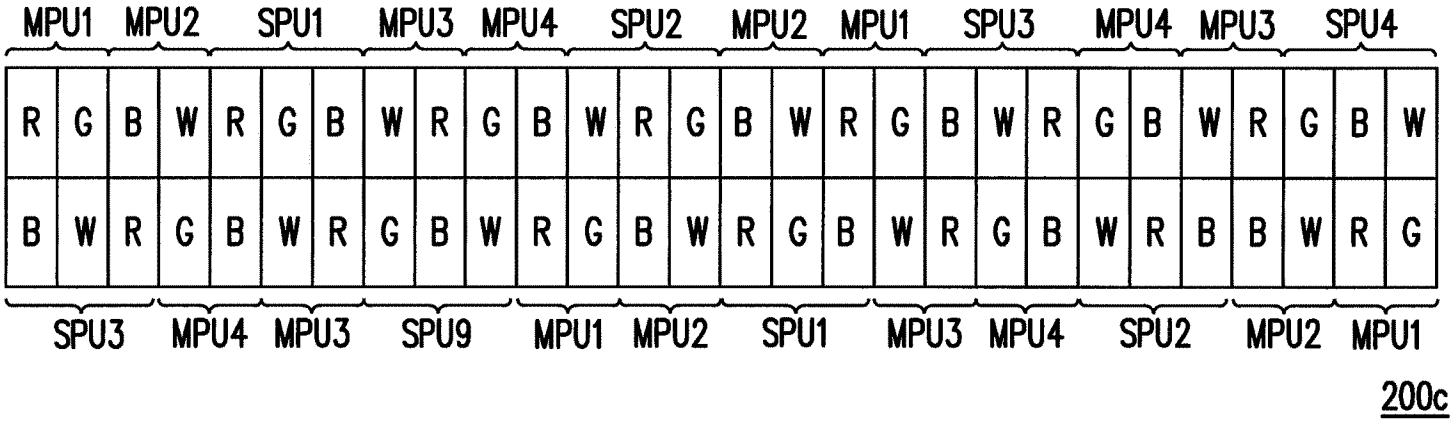

Referring to FIG. 12C, since the sub-pixel group 200*c* is written by 32 pixel data, and the sub-pixel arrangement of the sub-pixel group 200*c* is the same as the sub-pixel arrangement of the sub-pixel group 200*c* shown in FIG. 9C, details in this respect will not be repeated below. From left to right, the first row of the sub-pixel group 200*c* sequentially includes the main type pixel unit MPU1, the main type pixel unit MPU2, the sub type pixel unit SPU1, the main type pixel unit MPU3, the main type pixel unit MPU4, the sub type pixel unit SPU2, the main type pixel unit MPU2, the main type pixel unit MPU1, the sub type pixel unit SPU3, the main type pixel unit MPU4, the main type pixel unit MPU3, and the sub type pixel unit SPU4. From left to right, the second row of the sub-pixel group 200*c* sequentially includes the sub type pixel unit SPU3, the main type pixel unit MPU4, the main type pixel unit MPU3, the sub type pixel unit SPU9, the main type pixel unit MPU1, the main type pixel unit MPU2, the sub type pixel unit SPU1, the main type pixel unit MPU3, the main type pixel unit MPU4, the sub type pixel unit SPU2, the main type pixel unit MPU2, and the main type pixel unit MPU1.

Figure 12D:
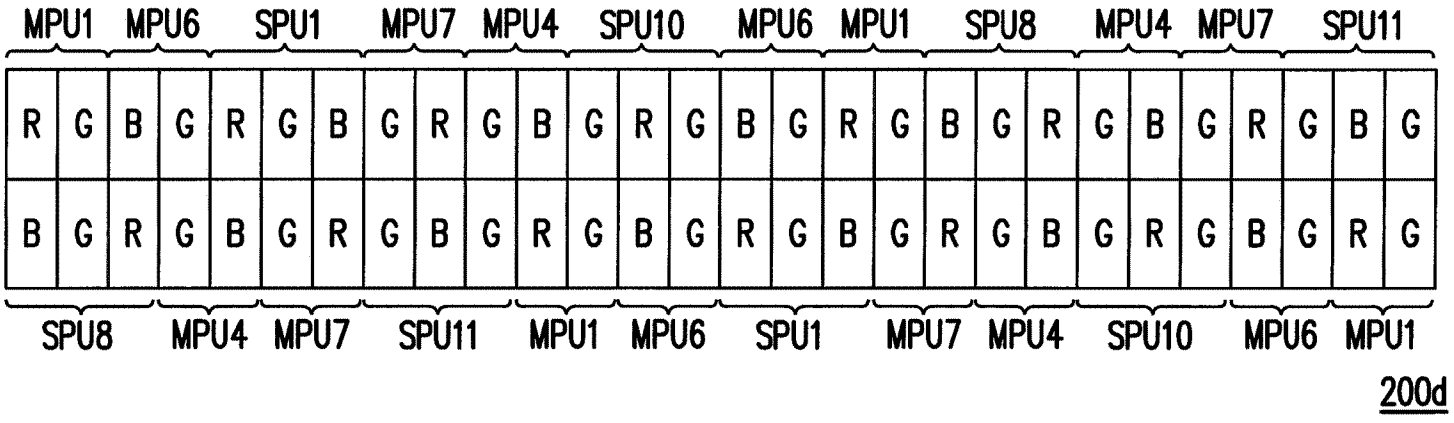

Referring to FIG. 12D, since the sub-pixel group 200*d* is written by 32 pixel data, and the sub-pixel arrangement of the sub-pixel group 200*d* is the same as the sub-pixel arrangement of the sub-pixel group 200*d* shown in FIG. 9D, details in this respect will not be repeated below. From left to right, the first row of the sub-pixel group 200*d* sequentially includes the main type pixel unit MPU1, the main type pixel unit MPU6, the sub type pixel unit SPU1, the main type pixel unit MPU7, the main type pixel unit MPU4, the sub type pixel unit SPU10, the main type pixel unit MPU6, the main type pixel unit MPU1, the sub type pixel unit SPU8, the main type pixel unit MPU4, the main type pixel unit MPU7, and the sub type pixel unit SPU11. From left to right, the second row of the sub-pixel group 200*d* sequentially includes the sub type pixel unit SPU8, the main type pixel unit MPU4, the main type pixel unit MPU7, the sub type pixel unit SPU11, the main type pixel unit MPU1, the main type pixel unit MPU6, the sub type pixel unit SPU1, the main type pixel unit MPU7, the main type pixel unit MPU4, the sub type pixel unit SPU10, the main type pixel unit MPU6, and the main type pixel unit MPU1.

Figure 12E:
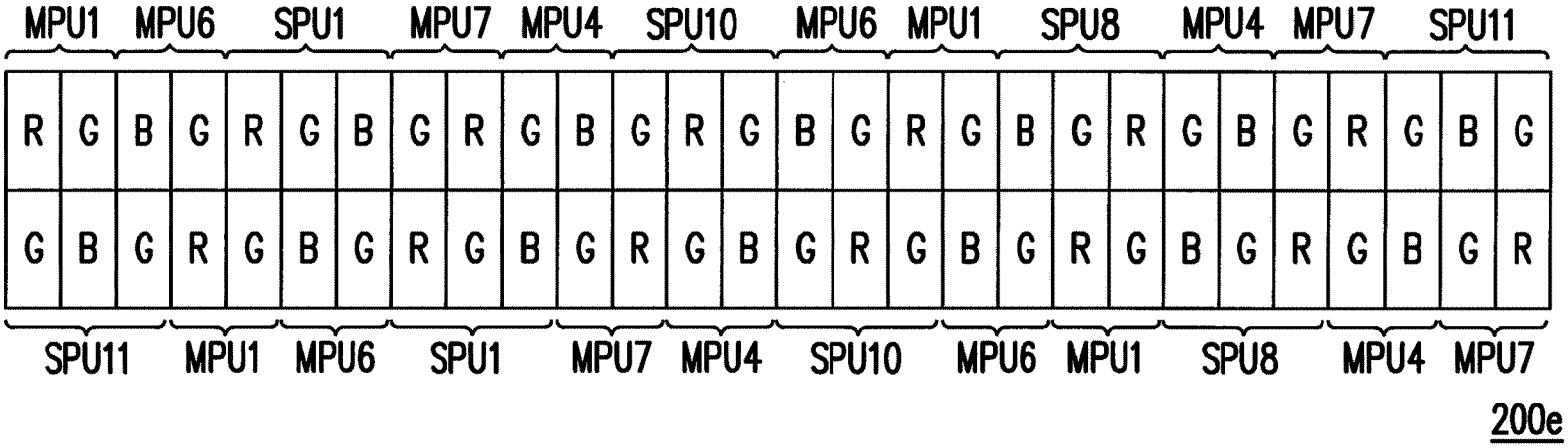

Referring to FIG. 12E, since the sub-pixel group 200*e* is written by 32 pixel data, and the sub-pixel arrangement of the sub-pixel group 200*e* is the same as the sub-pixel arrangement of the sub-pixel group 200*e* shown in FIG. 9E, details in this respect will not be repeated below. From left to right, the first row of the sub-pixel group 200*d* sequentially includes the main type pixel unit MPU1, the main type pixel unit MPU6, the sub type pixel unit SPU1, the main type pixel unit MPU7, the main type pixel unit MPU4, the sub type pixel unit SPU10, the main type pixel unit MPU6, the main type pixel unit MPU1, the sub type pixel unit SPU8, the main type pixel unit MPU4, the main type pixel unit MPU7, and the sub type pixel unit SPU11. From left to right, the second row of the sub-pixel group 200*d* sequentially includes the sub type pixel unit SPU11, the main type pixel unit MPU1, the main type pixel unit MPU6, the sub type pixel unit SPU1, the main type pixel unit MPU7, the main type pixel unit MPU4, the sub type pixel unit SPU10, the main type pixel unit MPU6, the main type pixel unit MPU1, the sub type pixel unit SPU8, the main type pixel unit MPU4, and the main type pixel unit MPU7.

It should be noted that the invention does not limit the number of sub-pixels of the sub-pixel group 200. For example, in another embodiment, the sub-pixel group 200 shown in FIG. 8 may include 60 sub-pixels. In other words, one sub-pixel group 200 may include the two scan lines SL1 and SL2 and 30 data lines DL1 to DL30.

Figure 13A:
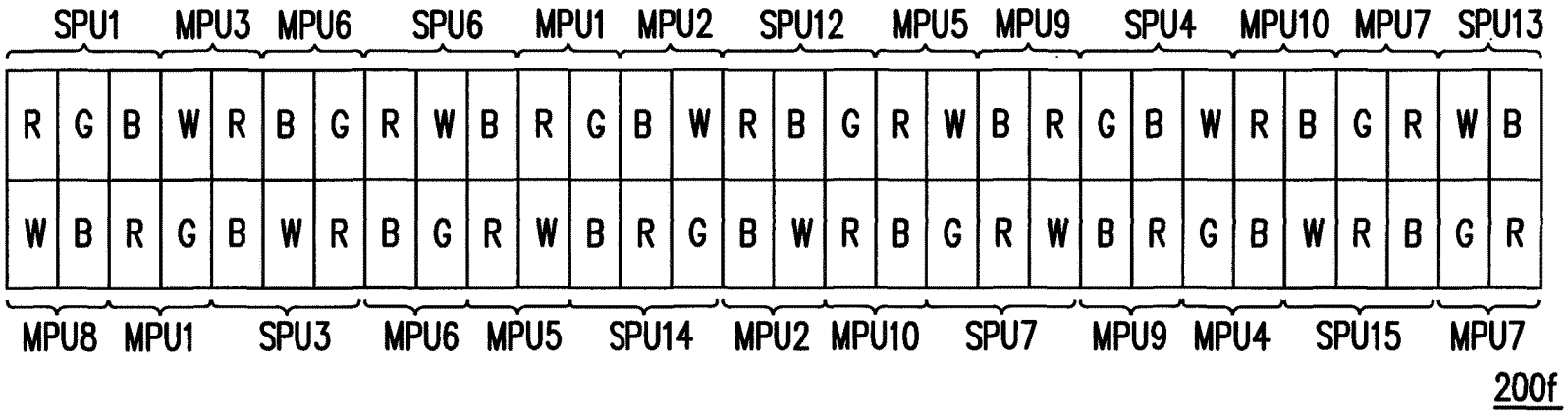
FIGS. 13A to 13B are schematic top views illustrating sub-pixel groups respectively formed by main type pixel units and sub type pixel units according to the third exemplary embodiment of the invention.
Figure 13B:
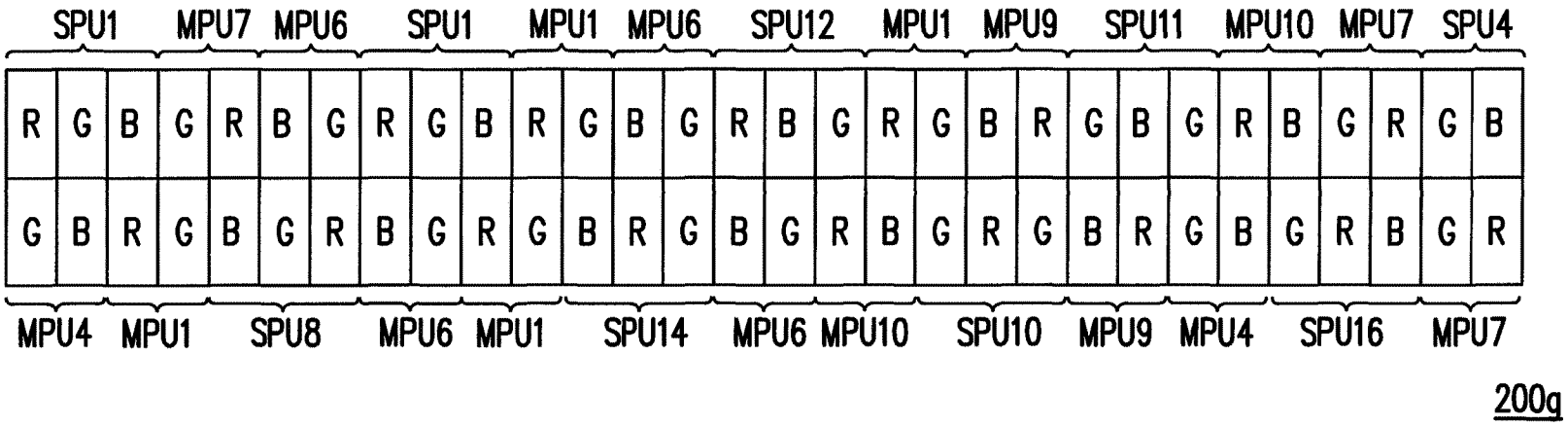

FIGS. 13A to 13B are schematic top views illustrating sub-pixel groups respectively formed by main type pixel units and sub type pixel units according to the third exemplary embodiment of the invention.

Referring to FIG. 13A, a sub-pixel group 200*f* includes 60 sub-pixels in an array with two rows and 30 columns (2×30). In addition, the 60 sub-pixels include 18 red pixels R, 12 green pixels G, 18 blue pixels B, and 12 white pixels W. In other words, a ratio between the sub-pixels of different colors (i.e., red pixel R:green pixel G:blue pixel B:white pixel W) is 3:2:3:2. Specifically, from left to right, the first row of the sub-pixel group 200*f* is formed by three sets of the red pixel R, the green pixel G, the blue pixel B, the white pixel W, the red pixel R, the blue pixel B, the green pixel G, the red pixel R, the white pixel W, and the blue pixel B in sequence, and the second row of the sub-pixel group 200*f* is formed by three sets of the white pixel W, the blue pixel B, the red pixel R, the green pixel G, the blue pixel B, the white pixel W, the red pixel R, the blue pixel B, the green pixel G, and the red pixel R in sequence. In this exemplary embodiment, since each of the main type pixel units is written by one of the pixel data, and each of the sub type pixel units is written by two of the pixel data, the sub-pixel group 200*f* is written by 34 pixel data. From left to right, the first row of the sub-pixel group 200*f* sequentially includes the sub type pixel unit SPU1, the main type pixel unit MPU3, the main type pixel unit MPU6, the sub type pixel unit SPU6, the main type pixel unit MPU1, the main type pixel unit MPU2, the sub type pixel unit SPU12, the main type pixel unit MPU5, the main type pixel unit MPU9, the sub type pixel unit SPU4, the main type pixel unit MPU10, the main type pixel unit MPU7, and the sub type pixel unit SPU13. From left to right, the second row of the sub-pixel group 200*f* sequentially includes the main type pixel unit MPU8, the main type pixel unit MPU1, the sub type pixel unit SPU3, the main type pixel unit MPU6, the main type pixel unit MPU5, the sub type pixel unit SPU14, the main type pixel unit MPU2, the main type pixel unit MPU10, the sub type pixel unit SPU7, the main type pixel unit MPU9, the main type pixel unit MPU4, the sub type pixel unit SPU15, and the main type pixel unit MPU7.

Referring to FIG. 13B, a sub-pixel group 200*g* includes 60 sub-pixels in an array with two rows and 30 columns (2×30). In addition, the 60 sub-pixels include 18 red pixels R, 24 green pixels G, and 18 blue pixels B. In other words, a ratio between the sub-pixels of different colors (i.e., red pixel R:green pixel G:blue pixel B) is 3:4:3. Specifically, from left to right, the first row of the sub-pixel group 200*g* is formed by three sets of the red pixel R, the green pixel G, the blue pixel B, the green pixel G, the red pixel R, the blue pixel B, the green pixel G, the red pixel R, the green pixel G, and the blue pixel B in sequence, and the second row of the sub-pixel group 200*g* is formed by three sets of the green pixel G, the blue pixel B, the red pixel R, the green pixel G, the blue pixel B, the green pixel G, the red pixel R, the blue pixel B, the green pixel G, and the red pixel R in sequence.

Similarly, the sub-pixel group 200*g* is written by 34 pixel data. From left to right, the first row of the sub-pixel group 200*g* sequentially includes the sub type pixel unit SPU1, the main type pixel unit MPU7, the main type pixel unit MPU6, the sub type pixel unit SPU1, the main type pixel unit MPU1, the main type pixel unit MPU6, the sub type pixel unit SPU12, the main type pixel unit MPU1, the main type pixel unit MPU9, the sub type pixel unit SPU11, the main type pixel unit MPU10, the main type pixel unit MPU7, and the sub type pixel unit SPU4. From left to right, the second row of the sub-pixel group 200*g* sequentially includes the main type pixel unit MPU4, the main type pixel unit MPU1, the sub type pixel unit SPU8, the main type pixel unit MPU6, the main type pixel unit MPU1, the sub type pixel unit SPU14, the main type pixel unit MPU6, the main type pixel unit MPU10, the sub type pixel unit SPU10, the main type pixel unit MPU9, the main type pixel unit MPU4, the sub type pixel unit SPU16, and the main type pixel unit MPU7.

Figure 14:
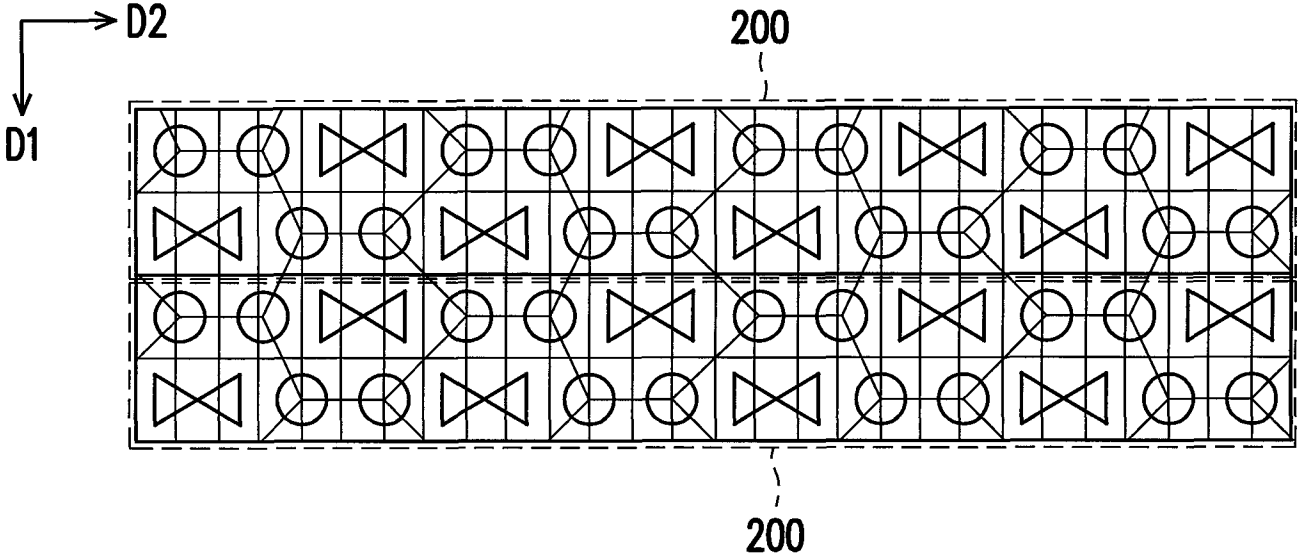
FIG. 14 is a schematic top view illustrating the pixel array 1200 having the sub-pixel groups 200 shown in FIG. 8 according to the third exemplary embodiment of the invention.

FIG. 14 is a schematic top view illustrating the pixel array 1200 having the sub-pixel groups 200 shown in FIG. 8 according to the third exemplary embodiment of the invention.

For the ease of illustration, FIG. 14 only illustrates two of the sub-pixel groups 200, and components such as the scan lines, data lines, and driving elements of the sub-pixels are omitted. As shown in FIG. 14, the pixel array 1200 is an array formed by the repeatedly arranged sub-pixel groups 200. It should be noted that the invention does not limit the sub-pixel groups forming the pixel array 1200. For example, the pixel array 1200 may be formed by the sub-pixel groups 200*a* to 200*e* shown in FIGS. 12A to 12E, and each of the sub-pixel groups 200*a* and 200*e* is written by 32 pixel data. However, the invention is not limited thereto. In another exemplary embodiment, the pixel array 1200 may still be formed by other sub-pixel groups. For example, the pixel array 1200 may be formed by the sub-pixel group 200*f* or 200*e* formed of the array with two rows and 30 columns (2×30), and each of the sub-pixel groups 200*f* and 200*e* is written by 34 pixel data. Here, circles are used to represent the main type pixel units in the pixel array 1200. It should be noted that, in this exemplary embodiment, since each of the sub type pixel units are written by two of the pixel data, two triangles are used to represent one sub type pixel unit in the pixel array 1200.

Referring to FIG. 14, in the pixel array 1200 formed by the circles representing the main type pixel units and the triangle sets, each including two triangles, representing the sub type pixel units, the main type pixel units and the sub type pixel units are alternately arranged in the first direction D1 parallel to the scan line of the pixel array 1200. Also, the main type pixel units and the sub type pixel units are alternately arranged in the second direction D2 parallel to the data line of the pixel array 1200. In the second direction D2, each of the sub type pixel units is disposed between each two of the main type pixel units. Accordingly, the main type pixel units in the pixel array 1200 form a plurality of hexagons. Particularly, in this exemplary embodiment, each of the sub type pixel units is written by two of the pixel data. Thus, the main type pixel units arranged into a hexagon surround one of the sub type pixel units written by two of the pixel data.

Figure 15:
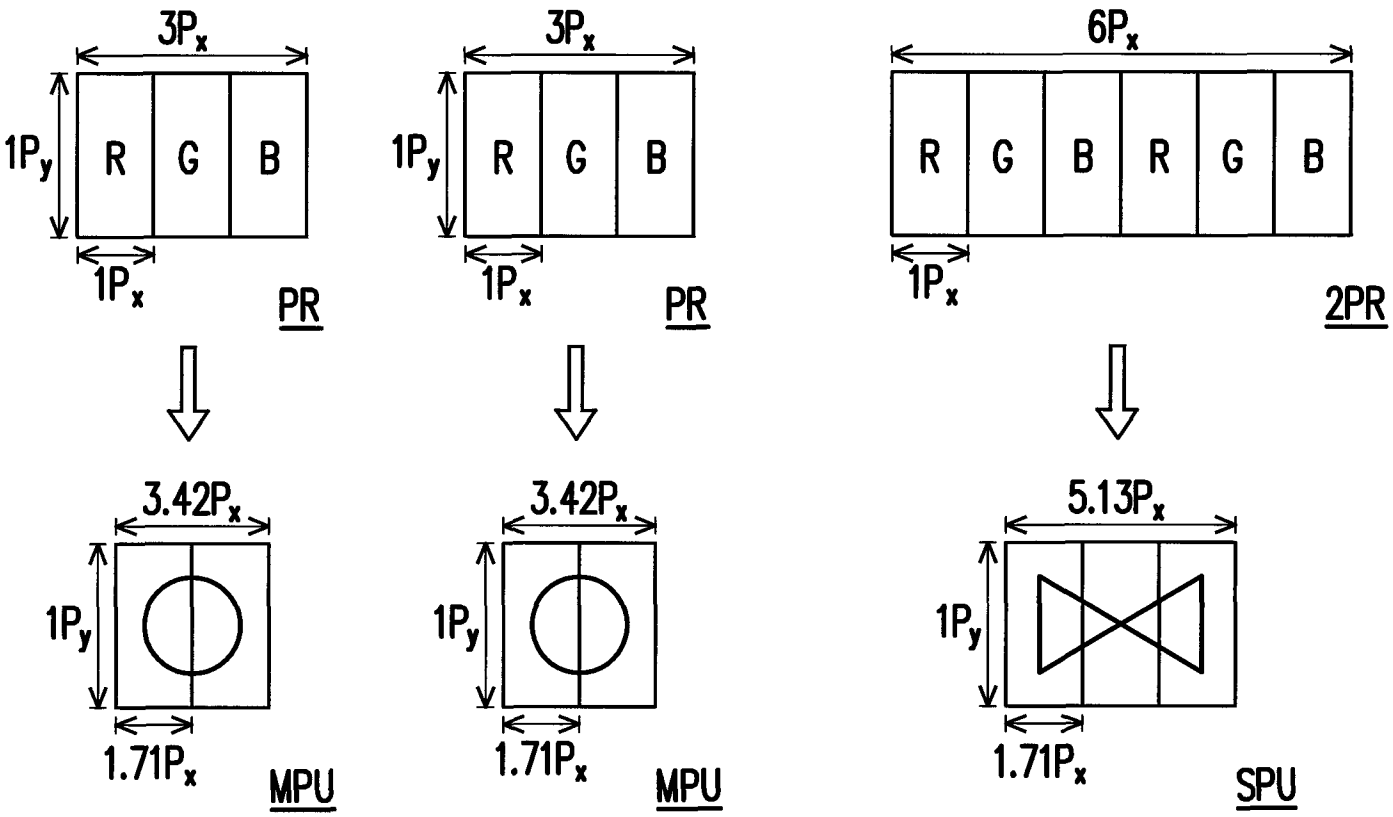
FIG. 15 is a diagram illustrating a corresponding relation between the normal pixel data and pixel data defined by an algorithm according to the third exemplary embodiment of the invention.

FIG. 15 is a diagram illustrating a corresponding relation between the normal pixel data and pixel data defined by an algorithm according to the third exemplary embodiment of the invention.

Referring to FIG. 15, in a conventional RGB strip type display panel, the pixel data corresponding to the pixel PR includes three sub-pixels, namely the red pixel R, green pixel G, and blue pixel B. In the exemplary embodiment of the invention, the pixel data are formed of arrangements of different numbers of sub-pixels of different colors, and the algorithm is used to map the pixel data to the main type pixel units MPU and the sub type pixel units SPU. The arrangements of the different numbers of sub-pixels of different colors in the main type pixel units MPU and the sub type pixel units SPU are already described in the foregoing, and thus not repeated below. For example, in this exemplary embodiment, each of the main type pixel units MPU includes sub-pixels of two different colors, and each of the sub type pixel units SPU includes sub-pixels of three different colors. More specifically, in the conventional display panel, four pixel data corresponding to four pixels PR include 12 sub-pixels. However, in the display panel of this exemplary embodiment, four pixel data corresponding to three pixel units correspond to seven sub-pixels (i.e., four sub-pixels of two main type pixel units MPU and three sub-pixels of one sub type pixel unit SPU). Namely, assuming that the size of the display panel remains the same, each pixel data has 7/4 sub-pixels in average. Therefore, the size of the sub-pixel in the main type pixel unit MPU and the sub type pixel unit SPU is 1.71 times of the size of the sub-pixel in the pixel PR. In other words, assuming that the width of the sub-pixel of the conventional RGB strip type display panel is 1P, a width of the sub-pixel of the display panel of this exemplary embodiment is 1.71P. In particular, since the size of the sub-pixel in the display panel of the invention is greater than that in the conventional RGB strip type display panel, the transmittance of the display panel 1000 is increased.

For example, assuming that the frame resolution of the display panel 1000 is 1920×1080, and in the exemplary embodiment of the invention, the pixel array 1200 includes the plurality of sub-pixels in the second direction D2, since each of the pixel data has 7/4 sub-pixels, the number of sub-pixels in the second direction D2 is equal to 7/4 times the resolution in the second direction D2 (i.e., 1080 ppi). In other words, the number of sub-pixels in the second direction D2 is 1890. In other words, a ratio between the number of sub-pixels in the second direction D2 and the resolution of the display panel 1000 in the second direction D2 is 7/4. Since the number of sub-pixels of the conventional RGB strip type display panel in the second direction D2 is 3240, the pixel density of the display panel 1000 according to the exemplary embodiment of the invention is relatively reduced, making each pitch between the adjacent red, green, and blue sub-pixels in the display panel 1000 not overly small. Thus, the yield rate in the manufacture and transmittance of the display panel are improved.

It should be noted that as shown in FIG. 15, two pixel data corresponding to the sub type pixel unit SPU correspond to three sub-pixels, and two pixel data corresponding to the main type pixel unit MPU correspond to four sub-pixels. In other words, a resolution capability of the main type pixel unit is higher than that of the sub type pixel unit. In particular, with the arrangement shown in FIG. 14, the main type pixel units having a higher resolution capability surrounds one of the sub type pixel units. Therefore, the clearness of the display panel is maintained.

In view of the foregoing, the display panel of the invention has the sub-pixel group formed with the white sub-pixels to improve the brightness and maintain the color performance of the display panel. Also, in the invention, the transmittance and yield rate of the manufacture of the display panel are improved by writing the pixel data formed of different numbers of sub-pixels to the main and sub type pixel units in the sub-pixel groups. Besides, in the display panel of the invention, with the arrangement that the main type pixel units surround the sub type pixel units, the resolution and clearness for displaying an image are maintained.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A display panel, comprising:

a plurality of sub-pixel groups, repeatedly arranged to form a pixel array, wherein each of the sub-pixel groups is written by a first number of pixel data, wherein each of the first number of pixel data comprises a red pixel data, a green pixel data and a blue pixel data, and each of the sub-pixel groups comprises:

a second number of main type pixel units, each of the main type pixel units is configured to display one of the pixel data by mapping the displayed pixel data to the corresponding main type pixel unit, wherein each main type pixel comprises sub-pixels of a third number of different colors, and each of the third number of different colors is selected from red, green, blue and another color; and a fourth number of sub type pixel units, each of the sub type pixel units is configured to display at least one of the pixel data by mapping the at least one displayed pixel data to the corresponding sub type pixel unit, wherein each sub type pixel comprises sub-pixels of a fifth number of different colors, and each of the fifth number of different colors is selected from red, green, blue and the another color, wherein the main type pixel units are arranged in the pixel array to form a geometrical shape and surround a single sub type pixel unit of the sub type pixel units, wherein each sub-pixel of the main type pixel units has a first size, each sub-pixel of the sub type pixel units has a second size, and the first size is the same as the second size, wherein the first number is greater than or equal to a summation of the second number and the fourth number.

2. The display panel as claimed in claim 1, wherein the main type pixel units are arranged in the pixel array to form a tetragon.

3. The display panel as claimed in claim 1, wherein the main type pixel units and the sub type pixel units are alternately arranged in a first direction of the pixel array, and the main type pixel units and the sub type pixel units are alternately arranged in a second direction of the pixel array.

4. The display panel as claimed in claim 1, wherein each of the main type pixel units comprises sub-pixels of three different colors.

5. The display panel as claimed in claim 4, wherein each of the sub type pixel units comprises sub-pixels of two different colors.

6. The display panel as claimed in claim 1, wherein the pixel array comprises a plurality of sub-pixels in a second direction, and a ratio between the number of the sub-pixels in the second direction and a resolution of the display panel in the second direction is 5/2.

7. The display panel as claimed in claim 1, wherein each of the sub type pixel units is written by a single one of the pixel data.

8. The display panel as claimed in claim 1, wherein the main type pixel units are arranged in the pixel array to form a hexagon.

9. The display panel as claimed in claim 1, wherein the main type pixel units and the sub type pixel units are alternately arranged in a first direction of the pixel array.

10. The display panel as claimed in claim 9, wherein the main type pixel units and the sub type pixel units are arranged in a second direction of the pixel may, and, in the second direction, each of the sub type pixel units is disposed between each two of the main type pixel units.

11. The display panel as claimed in claim 1, wherein each of the main type pixel units comprises sub-pixels of two different colors.

12. The display panel as claimed in claim 11, wherein each of the sub type pixel units comprises sub-pixels of three different colors.

13. The display panel as claimed in claim 1, wherein the pixel array comprises a plurality of sub-pixels in a second direction, and a ratio between the number of the sub-pixels in the second direction and a resolution of the display panel in the second direction is 7/3.

14. The display panel as claimed in claim 1, wherein the pixel array comprises a plurality of sub-pixels in a second direction, and a ratio between the number of the sub-pixels in the second direction and a resolution of the display panel in the second direction is 7/4.

15. The display panel as claimed in claim 1, wherein each of the sub type pixel units is written by two of the pixel data.

16. The display panel as claimed in claim 1, wherein the third number is different from the fifth number.

17. The display panel as claimed in claim 1, wherein each of the sub type pixel units is written by a plurality of the pixel data.

18. A display panel, comprising:

a plurality of sub-pixel groups, repeatedly arranged to form a pixel array, wherein each of the sub-pixel groups is written by a first number of pixel data, wherein each of the sub-pixel groups comprises:

a second number of first type pixel units, each of the first type pixel units is configured to display one of the pixel data by mapping the displayed pixel data to the corresponding first type pixel unit; and a third number of second type pixel units, each of the second type pixel units is configured to display at least one of the pixel data by mapping the at least one displayed pixel data to the corresponding second type pixel unit, wherein the first type pixel units are arranged in the pixel array to surround a single second type pixel unit of the second type pixel units, wherein each of the first type pixel units comprises sub-pixels each having a first size, each of the second type pixel units comprises sub-pixels each having a second size, and the first size is the same as the second size, wherein each of the first type pixel units comprises sub-pixels of a fourth number of different colors, and each of the fourth number of different colors is selected from red, green, blue and another color, and wherein each of the second type pixel units comprises sub-pixels of a fifth number of different colors, and each of the fifth number of different colors is selected from red, green, blue and the another color, wherein the fourth number is different from the fifth number, and the first number is greater than or equal to a summation of the second number and the third number.

19. The display panel as claimed in claim 18, wherein each of the sub type pixel units is written by a plurality of the pixel data.

20. A data mapping method for a display panel, wherein the display panel comprises: a plurality of sub-pixel groups, repeatedly arranged to form a pixel array, wherein each of the sub-pixel groups comprises: a first number of first type pixel units, each of the first type pixel units is configured to display one of a second number of pixel data; and a third number of second type pixel units, each of the second type pixel units is configured to display at least one of the second number of pixel data, wherein the first type pixel units are arranged in the pixel array to surround a single second type pixel unit of the second type pixel units, wherein each of the first type pixel units comprises sub-pixels each having a first size, each of the second type pixel units comprises sub-pixels each having a second size, and the first size is the same as the second size, and each of the first type pixel units comprises sub-pixels of a fourth number of different colors, and each of the fourth number of different colors is selected from red, green, blue and another color, and each of the second type pixel units comprises sub-pixels of a fifth number of different colors, and each of the fifth number of different colors is selected from red, green, blue and the another color, wherein the fourth number is different from the fifth number, and the second number is greater than or equal to a summation of the first number and the third number, the method comprising:

writing each of the sub-pixel groups by the second number of pixel data;

mapping one of the second number of written pixel data to the corresponding first type pixel unit; and mapping at least one of the plurality of written pixel data to the corresponding second type pixel unit.

* * * * *